US007483084B2

(12) United States Patent
Kawamura et al.

(10) Patent No.: US 7,483,084 B2
(45) Date of Patent: Jan. 27, 2009

(54) IMAGE DISPLAY APPARATUS AND IMAGE DISPLAY METHOD

(75) Inventors: Hideaki Kawamura, Moriyama (JP); Haruko Terai, Ibaraki (JP); Junta Asano, Ibaraki (JP); Mitsuhiro Kasahara, Hirakata (JP)

(73) Assignee: Panasonic Corporation, Osaka (JP)

( * ) Notice: Subject to any disclaimer, the term of this patent is extended or adjusted under 35 U.S.C. 154(b) by 795 days.

(21) Appl. No.: 10/542,416

(22) PCT Filed: Dec. 26, 2003

(86) PCT No.: PCT/JP03/17076

§ 371 (c)(1),
(2), (4) Date: Jul. 15, 2005

(87) PCT Pub. No.: WO2004/064028

PCT Pub. Date: Jul. 29, 2004

(65) Prior Publication Data

US 2006/0072044 A1 Apr. 6, 2006

(30) Foreign Application Priority Data

Jan. 16, 2003 (JP) ..... 2003-007974
Dec. 24, 2003 (JP) ..... 2003-428291

(51) Int. Cl.
*H04N 5/57* (2006.01)
*G09G 3/28* (2006.01)

(52) U.S. Cl. ..... 348/687; 348/701; 348/797; 348/671; 345/690; 345/691; 345/77

(58) Field of Classification Search ..... 348/687, 348/671, 701, 700, 699, 797, 800; 345/690–696, 345/37, 41, 60, 63, 72, 76, 77, 89; 358/2.1, 358/3.01, 3.03

See application file for complete search history.

(56) References Cited

U.S. PATENT DOCUMENTS 5,173,770 A 12/1992 Kondo et al.

(Continued)

FOREIGN PATENT DOCUMENTS

CN 1383540 12/2002
EP 0454483 10/1991

(Continued)

OTHER PUBLICATIONS

U.S. Appl. No. 10/541,544 to Terai et al., filed Jul. 6, 2005.

(Continued)

*Primary Examiner*—David L Ometz
*Assistant Examiner*—Jean W Désir
(74) *Attorney, Agent, or Firm*—Greenblum & Bernstein, P.L.C.

(57) ABSTRACT

In an image display apparatus, a video signal is divided for each field into a plurality of sub-fields, each of which is weighted according to the duration of time or number of pulses. The plurality of sub-fields are temporally superimposed for display, so that a grayscale representation is provided. A video signal for the current field is delayed by one field, and output as a video signal for the previous field. Based on the video signal for the current field and the video signal for the previous field, a luminance gradient of an image is detected. A difference between the video signal for the current field and the video signal for the previous field is calculated. Based on the calculated difference and the detected gradient, the amount of motion of the image is calculated by a detecting circuit. Based on the calculated amount of motion of the image, dynamic false contours are reduced by an image data processing circuit.

20 Claims, 14 Drawing Sheets

U.S. PATENT DOCUMENTS

| | | | | |
|---|---|---|---|---|
| 6,222,512 | B1 * | 4/2001 | Tajima et al. | 345/63 |
| 6,243,073 | B1 * | 6/2001 | Kawamura et al. | 345/690 |
| 6,249,265 | B1 * | 6/2001 | Tajima et al. | 345/63 |
| 6,310,588 | B1 | 10/2001 | Kawahara et al. | |
| 6,333,766 | B1 * | 12/2001 | Kougami et al. | 348/687 |
| 6,456,302 | B2 | 9/2002 | Kawahara et al. | |
| 6,496,194 | B1 * | 12/2002 | Mikoshiba et al. | 345/596 |
| 6,661,470 | B1 * | 12/2003 | Kawamura et al. | 348/699 |
| 6,924,778 | B2 * | 8/2005 | Awamoto et al. | 345/60 |
| 7,161,576 | B2 * | 1/2007 | Kawabe et al. | 345/99 |
| 7,295,173 | B2 * | 11/2007 | Itoh et al. | 345/63 |
| 2001/0028347 | A1 | 10/2001 | Kawahara et al. | |
| 2002/0135595 | A1 | 9/2002 | Morita et al. | |

FOREIGN PATENT DOCUMENTS

| | | |
|---|---|---|
| EP | 0949585 | 10/1999 |
| JP | 4-10885 | 1/1992 |
| JP | 4-010885 | 1/1992 |
| JP | 11-212517 | 8/1999 |
| JP | 11-231827 | 8/1999 |
| JP | 2001-034223 | 9/2001 |
| JP | 2001-34223 | 9/2001 |
| JP | 2001-268349 | 9/2001 |

OTHER PUBLICATIONS

An article entitled "A Study of False Contour Noise Reduction in Moving Images of PDP" published in the 1996 IEICE Electronics Society Convention, along with an English language translation thereof.
English Language Abstract of JP 2001-34223.
English Language Abstract of JP 11-231827.
English Language Abstract of JP 2001-268349.
English Language Abstract of JP 4-10885.
English Language Abstract of JP11-212517.

* cited by examiner

IMAGE DISPLAY APPARATUS AND IMAGE DISPLAY METHOD

TECHNICAL FIELD

The present invention relates to image display apparatuses that display a video signal as an image and an image display method.

BACKGROUND ART

In order to meet recent demands for larger image display apparatuses, thin-type matrix panels have begun to be available such as Plasma Display Panels (PDPs), electroluminescent (EL) display devices, fluorescent display tubes, and liquid crystal display devices. Among such thin-type image display apparatuses, PDPs, in particular, are very promising as direct-view image display apparatuses with larger screens.

One method for grayscale representation on a PDP is an inter-field time division method, referred to as a sub-field method. In the inter-field time division method, one field is composed of a plurality of images (hereinafter referred to as sub-fields) with different luminance weights. The sub-field method as a method for grayscale representation is an excellent technique allowing the representation of multiple levels of gray even in binary image display apparatuses such as PDPs; i.e., display apparatuses that can represent only two levels of gray, 1 and 0. The use of this sub-field method as a method for grayscale representation allows PDPs to provide image quality substantially equal to that of cathode-ray-tube type image display apparatuses.

However, for example, when a moving image in which the gradation is gradually changing is displayed, the so-called false contour is generated that is peculiar to images on a PDP. Such generation of a false contour is due to the visual characteristics of a human, a phenomenon that seems as if grayscale had been lost, in which a color different from the original color to be represented appears as a stripe. This false contour in moving images is hereinafter referred to as a dynamic false contour.

JP 2001-34223 A suggests a method for displaying moving images and an apparatus for displaying moving images using this method, in which image correction processing is performed by detecting the amount of motion and direction of an image by a block matching method for reducing dynamic false contours. In the method and apparatus for displaying moving images, dynamic false contours are reduced by applying diffusion processing to blocks (areas) of an image for which motion vector is not accurately detected.

However, the block matching method used in the foregoing method and apparatus for displaying moving images requires determining correlations between a block to be detected and a plurality of prepared candidate blocks to detect a motion vector, which necessitates many line memories and operating circuits, and adds complexity to the circuit configuration.

It is thus desired to detect the amount of motion of an image with a simple structure. It is also desired to reduce dynamic false contours based on the amount of motion of an image without using a motion vector of the image.

DISCLOSURE OF INVENTION

An object of the present invention is to provide an image display apparatus and an image display method allowing the detection of the amount of motion of an image through a simple structure.

Another object of the present invention is to provide an image display apparatus and an image display method allowing a reduction in dynamic false contours based on the amount of motion of an image without using the motion vector of the image.

An image display apparatus according to one aspect of the present invention that displays an image based on a video signal comprises a grayscale display unit that divides the video signal for each field into a plurality of sub-fields, each of which is weighted according to the duration of time or number of pulses, and temporally superimposes the plurality of sub-fields for display to provide a grayscale representation; a field delay unit that delays a video signal for a current field by one field, and outputs the delayed video signal as a video signal for a previous field; a luminance gradient detector that detects a luminance gradient of the image based on the video signal for the current field and the video signal for the previous field output from the field delay unit; a differential calculator that calculates a difference between the video signal for the current field and the video signal for the previous field output from the field delay unit; and a motion amount calculator that calculates an amount of motion of the image based on the difference calculated by the differential calculator and the gradient detected by the luminance gradient detector.

In the image display apparatus, a video signal is divided, for each field, into a plurality of sub-fields each of which is weighted according to the duration of time or number of pulses. The plurality of sub-fields are temporally superimposed for display, so that a grayscale representation is provided. Moreover, a video signal for the current field is delayed by one field, and output as a video signal for the previous field. Based on the video signal for the current field and the video signal for the previous field, the luminance gradient of an image is detected by the luminance gradient detector. The difference between the video signal for the current field and the video signal for the previous field is calculated by the differential calculator. Based on the calculated difference and the detected gradient, the amount of motion of the image is calculated by the motion amount calculator. In this manner, the amount of motion of the image can be detected through a simple structure based on the luminance gradient and the luminance difference of the image.

The luminance gradient detector may include a gradient determiner that detects a plurality of gradient values based on the video signal for the current field and the video signal for the previous field output from the field delay unit to determine a luminance gradient of the image based on the plurality of gradient values.

In this case, a plurality of gradient values are detected based on the video signal for the current field and the video signal for the previous field, and based on the plurality of gradient values, the luminance gradient of the image is determined. This results in the calculation of the amount of motion of the image.

The luminance gradient detector may include an average gradient determiner that determines an average value of the plurality of gradient values as a luminance gradient of the image. In this case, a plurality of gradient values are detected based on the video signal for the current field and the video signal for the previous field, and the luminance gradient of the image is determined based on the average value of the plurality of gradient values. This results in the calculation of the average amount of motion of the image.

The luminance gradient detector may include a maximum gradient determiner that determines a maximum value of the plurality of gradient values as a luminance gradient of the image. In this case, a plurality of gradient values are detected based on the video signal for the current field and the video signal for the previous field, and the luminance gradient of the image is determined based on the maximum value of the plurality of gradient values. This results in the calculation of the amount of motion of the image.

The video signal may include a red signal, a green signal, and a blue signal, the luminance gradient detector may include a color signal gradient detector that detects gradients between a red signal for the current field and a red signal for the previous field output from the field delay unit, between a green signal for the current field and a green signal for the previous field output from the field delay unit, and between a blue signal for the current field and a blue signal for the previous field output from the field delay unit, respectively, and the differential calculator may include a color signal differential calculator that calculates differences between the red signal for the current field and the red signal for the previous field output from the field delay unit, between the green signal for the current field and the green signal for the previous field output from the field delay unit, and between the blue signal for the current field and the blue signal for the previous field output from the field delay unit, respectively.

In this case, the gradients and differences between the red signals for the current and previous fields, green signals for the current and previous fields, and blue signals for the current and previous fields, respectively, can be detected. This results in the calculation of the amount of motion of the image for each color.

The video signal may include a red signal, a green signal, and a blue signal, and the image display apparatus may further comprise a luminance signal generator that generates a luminance signal for the current field by synthesizing the red, green, and blue signals for the current field at a ratio of approximately 0.30:0.59:0.11, and generates a luminance signal for the previous field by synthesizing the red, green, and blue signals output from the field delay unit at a ratio of approximately 0.30:0.59:0.11, and wherein the luminance gradient detector may detect a luminance gradient of the image based on the luminance signal for the current field and the luminance signal for the previous field output from the field delay unit, and the differential calculator may calculate a difference between the luminance signal for the current field and the luminance signal for the previous field output from the field delay unit.

In this case, the red, green, and blue signals are synthesized at a ratio of approximately 0.30:0.59:0.11, whereby a luminance signal is generated. This allows the detection of a luminance gradient close to that of an actual image and the detection of a luminance difference close to that of an actual image.

The video signal may include a red signal, a green signal, and a blue signal, and the image display apparatus may further comprise a luminance signal generator that generates a luminance signal for the current field by synthesizing red, green, and blue signals for the current field at any of the ratios of approximately 2:1:1, approximately 1:2:1, and approximately 1:1:2, and generates a luminance signal for the previous field by synthesizing red, green, and blue signals for the previous field output from the field delay unit at any of the ratios of approximately 2:1:1, approximately 1:2:1, and approximately 1:1:2, and wherein the luminance gradient detector may detect a luminance gradient of the image based on the luminance signal for the current field and the luminance signal for the previous field output from the field delay unit, and the differential calculator may calculate a difference between the luminance signal for the current field and the luminance signal for the previous field output from the field delay unit.

In this case, the red, green, and blue signals are synthesized at any of the ratios of approximately 2:1:1, 1:2:1, and 1:1:2, whereby a luminance signal is generated. This allows the detection of a luminance gradient through a simpler structure and the detection of a luminance difference through a simpler structure.

The video signal may include a luminance signal, and the luminance gradient detector may detect a gradient based on the luminance signal.

In this case, a gradient can be detected based on the luminance signal in the video signal. This leads to the detection of a luminance gradient through a smaller circuit.

The luminance gradient detector may include a gradient value detector that detects a plurality of gradient values using video signals of a plurality of pixels surrounding a pixel of interest.

In this case, an accurate gradient value can be detected regardless of the moving direction of the image.

The motion amount calculator may include calculating the amount of motion by calculating a ratio of the difference calculated by the differential calculator to the luminance gradient of the image detected by the luminance gradient detector.

In this case, the amount of motion is calculated according to the ratio of a difference to a gradient, allowing the calculation of the amount of motion through a simpler structure without the need of many line memories and operating circuits.

The video signal may include a red signal, a green signal, and a blue signal, and the luminance gradient detector may include a color signal gradient detector that detects gradients between a red signal for the current field and a red signal for the previous field output from the field delay unit, between a green signal for the current field and a green signal for the previous field output from the field delay unit, and between a blue signal for the current field and a blue signal for the previous field output from the field delay unit, respectively, the differential detector may include a color signal differential calculator that calculates differences between the red signal for the current field and the red signal for the previous field output from the field delay unit, between the green signal for the current field and the green signal for the previous field output from the field delay unit, and between the blue signal for the current field and the blue signal for the previous field output from the field delay unit, respectively, and the motion amount calculator may calculate a ratio of the difference between the red signals calculated by the color signal differential calculator to the gradient between the red signals detected by the color signal gradient detector, a ratio of the difference between the green signals calculated by the color signal differential calculator to the gradient between the green signals detected by the color signal gradient detector, and a ratio of the difference between the blue signals calculated by the color signal differential calculator to the gradient between the blue signals detected by the color signal gradient detector, so as to determine amounts of motion corresponding to the red, green, and blue signals, respectively.

In this case, the calculation of ratios of the differences and the gradients for the red signals, green signals, and blue signals, respectively, allow the determination of the amounts of motion corresponding to the signals of the respective colors. This leads to the calculation of the amount of motion of the image for each color through a simple structure without the need of many line memories and operating circuits.

The image display apparatus may further comprise an image processor that performs image processing on the video signal based on the amount of motion of the image calculated by the motion amount calculator.

In this case, image processing is accomplished based on the amount of motion of the image through a simple structure without the use of the image motion vector.

The image processor may include a diffusion processor that performs diffusion processing based on the amount of motion calculated by the motion amount calculator.

In this case, the diffusion processing based on the amount of motion of the image allows a more effective reduction of dynamic false contours without increasing a perception of noise.

The diffusion processor may vary an amount of diffusion based on the amount of motion calculated by the motion amount calculator.

In this case, the diffusion processing based on the amount of motion of the image allows an even more effective reduction of dynamic false contours.

The diffusion processor may perform a temporal and/or spatial diffusion based on the amount of motion calculated by the motion amount calculator in the grayscale representation by the grayscale display unit.

In this case, a difference between an unrepresentable grayscale level that is not used for reducing dynamic false contours and a representable grayscale level is diffused temporally and/or spatially, allowing the unrepresentable grayscale level to be equivalently represented using the representable grayscale level. This results in a still more effective reduction of dynamic false contours while increasing the number of grayscale levels.

The diffusion processor may perform error diffusion so as to diffuse a difference between an unrepresentable grayscale level and a representable grayscale level close to the unrepresentable grayscale level to surrounding pixels based on the amount of motion calculated by the motion amount calculator in the grayscale representation by the grayscale display unit.

In this case, unrepresentable grayscale levels that are not used for reducing dynamic false contours can be represented equivalently using representable grayscale levels. This results in an even more effective reduction of dynamic false contours while increasing the number of grayscale levels.

The image processor may select a combination of grayscale levels based on the amount of motion calculated by the motion amount calculator in the grayscale representation by the grayscale display unit.

In this case, based on the amount of motion of the image, a combination of grayscale levels that is unlikely to cause a dynamic false contour can be readily selected.

The image processor may select a combination of grayscale levels that is more unlikely to cause a dynamic false contour as the amount of motion calculated by the motion amount calculator becomes greater.

In this case, since the possibility of the generation of a dynamic false contour is higher with a greater amount of motion, grayscale levels unlikely to cause a dynamic false contour can be selected based on the amount of motion of the image. This results in a still more effective reduction of dynamic false contours.

An image display method according to another aspect of the present invention for displaying an image based on a video signal comprises the steps of dividing the video signal for each field into a plurality of sub-fields, each of which is weighted according to the duration of time or number of pulses, and temporally superimposing the plurality of sub-fields for display to provide a grayscale representation; delaying a video signal for a current field by one field to output the delayed video signal as a video signal for a previous field; detecting a luminance gradient of the image based on the video signal for the current field and the video signal for the previous field; calculating a difference between the video signal for the current field and the video signal for the previous field; and calculating an amount of motion of the image based on the calculated difference and the detected gradient.

In the image display method, a video signal is divided, for each field, into a plurality of sub-fields each of which is weighted according to the duration of time or number of pulses. The plurality of sub-fields are temporally superimposed, so that a grayscale representation is provided. Moreover, a video signal for the current field is delayed by one field, and output as a video signal for the previous field. Based on the video signal for the current field and the video signal for the previous field, the luminance gradient of an image is detected. The difference between the video signal for the current field and the video signal for the previous field is calculated. Based on the calculated difference and the detected gradient, the amount of motion of the image is calculated. In this manner, the amount of motion of the image can be detected through a simple structure based on the luminance gradient and the luminance difference of the image.

The image display method may further comprise the step of performing image processing on the video signal based on the calculated amount of motion of the image.

In this case, image processing is accomplished based on the amount of motion of the image through a simple structure without using the image motion vector.

BEST MODE FOR CARRYING OUT THE INVENTION

Image display apparatuses and an image display method according to the present invention will be described below with reference to the drawings.

First Embodiment

Figure 1:
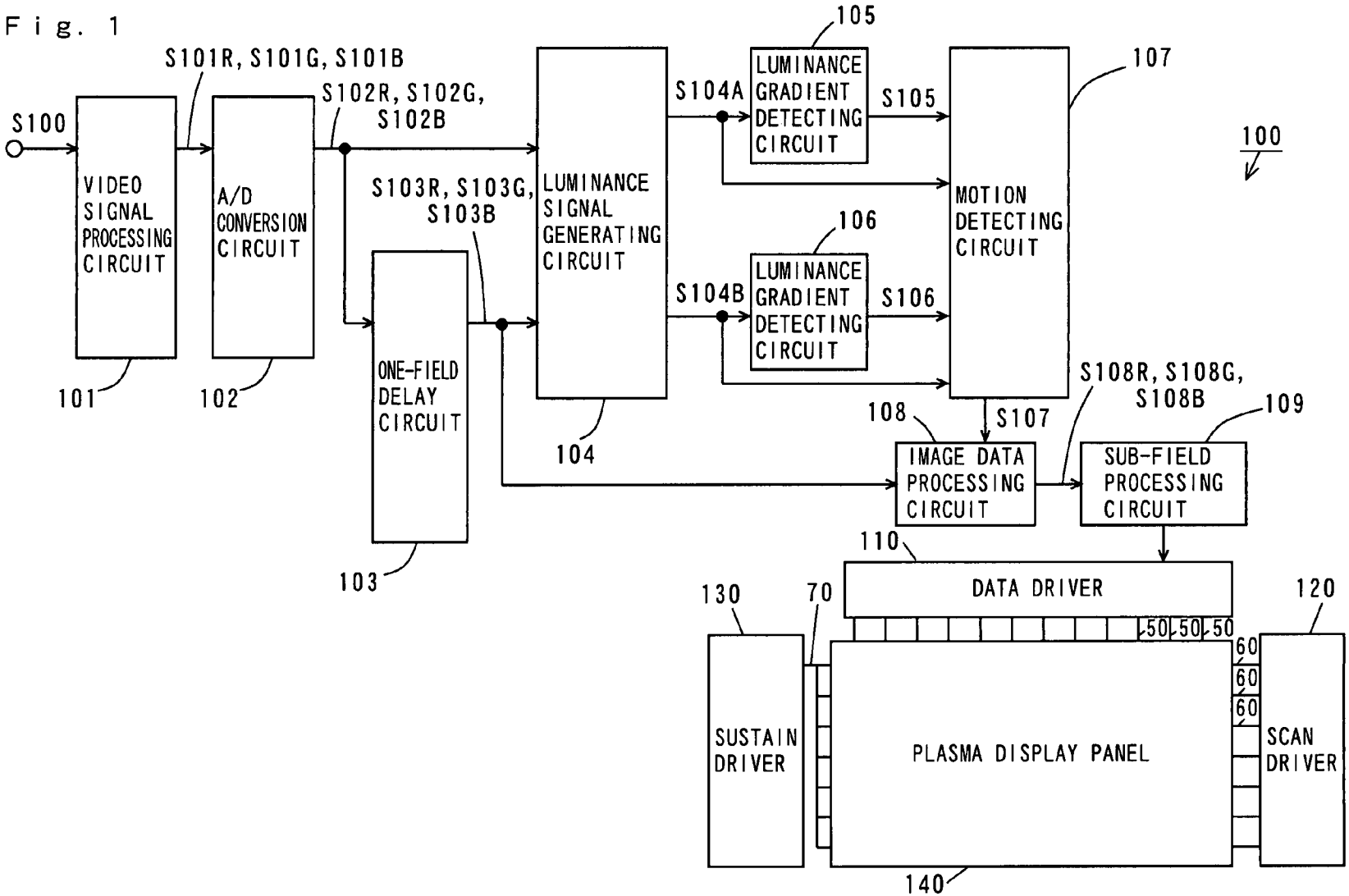
FIG. 1 is a diagram showing the general configuration of an image display apparatus according to a first embodiment of the invention.

FIG. 1 is a diagram showing the general configuration of an image display apparatus according to a first embodiment of the invention.

The image display apparatus 100 of FIG. 1 includes a video signal processing circuit 101, an A/D (Analog-to-Digital) conversion circuit 102, a one-field delay circuit 103, a luminance signal generating circuit 104, luminance gradient detecting circuits 105, 106, a motion detecting circuit 107, an image data processing circuit 108, a sub-field processing circuit 109, a data driver 110, a scan driver 120, a sustain driver 130, a plasma display panel (hereinafter abbreviated to a PDP) 140, and a timing pulse generating circuit (not shown).

The PDP 140 includes a plurality of data electrodes 50, scan electrodes 60, and sustain electrodes 70. The plurality of data electrodes 50 are vertically arranged on a screen, and the plurality of scan electrodes 60 and sustain electrodes 70 are horizontally arranged on the screen. The plurality of sustain electrodes 70 are connected with each other.

A discharge cell is formed at each intersection of a data electrode 50, a scan electrode 60, and a sustain electrode 70. Each discharge cell forms a pixel on the PDP 140.

A video signal S100 is input to the video signal processing circuit 101 of FIG. 1. The video signal processing circuit 101 separates the input video signal S100 into a red (R) analog video signal S101R, a green (G) analog video signal S101G, and a blue (B) analog video signal S101B, and supplies the signals to the A/D conversion circuit 102. The A/D conversion circuit 102 converts the analog signals S101R, S101G, S101B to digital image data S102R, S102G, S102B, and supplies the digital image data to the one-field delay circuit 103 and the luminance signal generating circuit 104.

The one-field delay circuit 103 delays the digital image data S102R, S102G, S102B by one field using a field memory incorporated therein, and supplies the delayed digital image data as digital image data S103R, S103G, S103B to the luminance signal generating circuit 104 and the image data processing circuit 108.

The luminance signal generating circuit 104 converts the digital image data S102R, S102G, S102B into a luminance signal S104A, and supplies the signal to the luminance gradient detecting circuit 105 and the motion detecting circuit 107. The luminance signal generating circuit 104 also converts the digital image data S103R, S103G, S103B to a luminance signal S104B, and supplies the signal to the luminance gradient detecting circuit 106 and the motion detecting circuit 107.

The luminance gradient detecting circuit 105 detects a luminance gradient for the current field from the luminance signal S104A, and supplies a luminance gradient signal S105 representing the luminance gradient to the motion detecting circuit 107.

Similarly, the luminance gradient detecting circuit 106 detects a luminance gradient for the previous field from the luminance signal S104B, and supplies a luminance gradient signal S106 representing the luminance gradient to the motion detecting circuit 107.

The motion detecting circuit 107 generates a motion detecting signal S107 from the luminance signals S104A, S104B and luminance signals S105, S106, and supplies the signal to the image data processing circuit 108. The motion detecting circuit 107 will be described in detail below.

The image data processing circuit 108 performs image processing based on the motion detecting signal S107, using the digital image data S103R, S103G, S103B, and supplies resulting image data S108 to the sub-field processing circuit 109. The image data processing circuit 108 in this embodiment performs image processing for reducing dynamic false contour noises. The image processing for reducing dynamic false contour noises will be described below.

The timing pulse generating circuit (not shown) supplies each circuit with timing pulses generated from the input video signal S100 through synchronizing separation.

The sub-field processing circuit 109 converts the image data S108R, S108G, S108B into sub-field data for each pixel, and supplies the data to the data driver 110.

The data driver 110 selectively supplies write pulses to the plurality of data electrodes 50 based on the sub-field data obtained from the sub-field processing circuit 109. The scan driver 120 drives each scan electrode 60 based on a timing signal supplied from the timing pulse generating circuit (not shown), while the sustain driver 130 drives the sustain electrodes 70 based on the timing signal from the timing pulse generating circuit (not shown). This allows an image to be displayed on the PDP 140.

The PDP 140 of FIG. 1 employs an ADS (Address Display-Period Separation) system as a method for grayscale representation.

Figure 2:
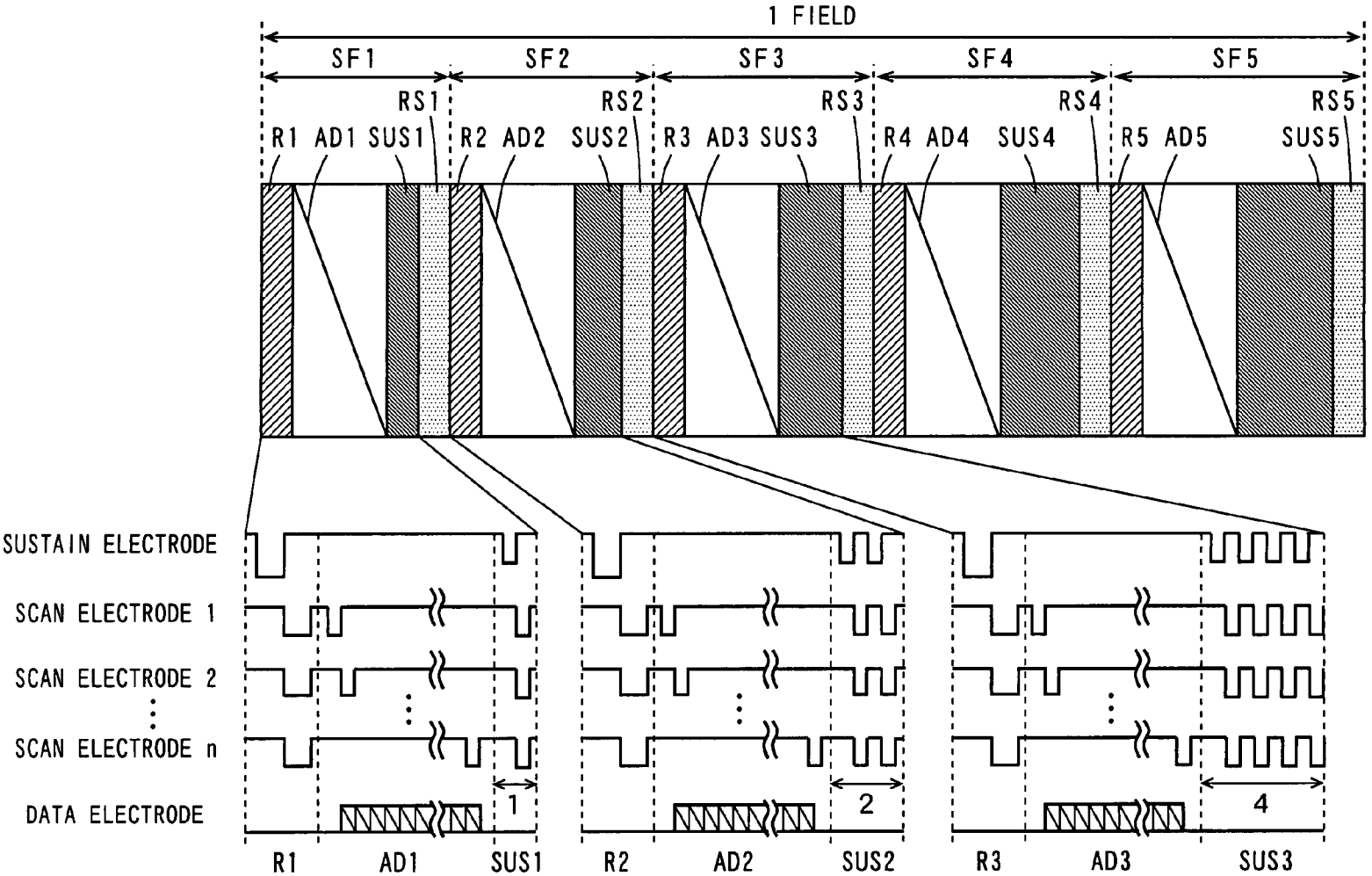
FIG. 2 is a diagram for use in illustrating an ADS system that is applied to the PDP shown in FIG. 1.

FIG. 2 is a diagram for use in illustrating the ADS system that is applied to the PDP 140 shown in FIG. 1. Although FIG. 2 shows an example of negative pulses that cause discharges during the fall time of the drive pulses, basic operations shown below apply similarly to the case of positive pulses that cause discharges during the rise time.

In the ADS system, one field is temporally divided into a plurality of sub-fields. For example, one field is divided into fives sub-fields, SF1, SF2, SF3, SF4, SF5. The sub-fields SF1, SF2, SF3, SF4, SF5, respectively, are further separated into initialization periods R1-R5, write periods AD1-AD5, sustain periods SUS1-SUS5, and erase periods RS1-RS5. In each of the initialization periods R1-R5, an initialization process for each sub-field is performed. In each of the write periods AD1-AD5, an address discharge is caused for selecting a discharge cell to be illuminated. In each of the sustain periods SUS1-SUS5, a sustain discharge is caused for display.

In each of the initialization periods R1-R5, a single initialization pulse is applied to the sustain electrodes 70, and a single initialization pulse is applied to each of the scan electrodes 60. This causes a preliminary discharge.

In each of the write periods AD1-AD5, the scan electrodes 60 are sequentially scanned, and a predetermined write process is applied to a discharge cell of the data electrodes 50 that has received a write pulse. This causes an address discharge.

In each of the sustain periods SUS1-SUS5, the number of sustain pulses corresponding to the weight that is set for each of the sub-fields SF1-SF5 are output to sustain electrodes 70 and scan electrodes 60. For example, in the sub-field SF1, one sustain pulse is applied to the sustain electrodes 70, and one sustain pulse is applied to a scan electrode 60, causing two sustain discharges in the selected discharge cells during the write period AD1. In the sub-field SF2, two sustain pulses are applied to sustain electrodes 70, and two sustain pulses are applied to scan electrodes 60, causing four sustain discharges in the selected cells during the write period AD2.

As described above, in the sub-fields SF1-SF5, one, two, four, eight, and sixteen sustain pulses, respectively, are applied to sustain electrodes 70 and scan electrodes 60, causing the discharge cells to emit light at brightnesses (luminances) corresponding to the respective numbers of pulses. In other words, the sustain periods SUS1-SUS5 are periods in which the discharge cells selected in the respective write periods AD1-AD5 discharge the numbers of times corresponding to the respective brightness weights.

Figure 3:
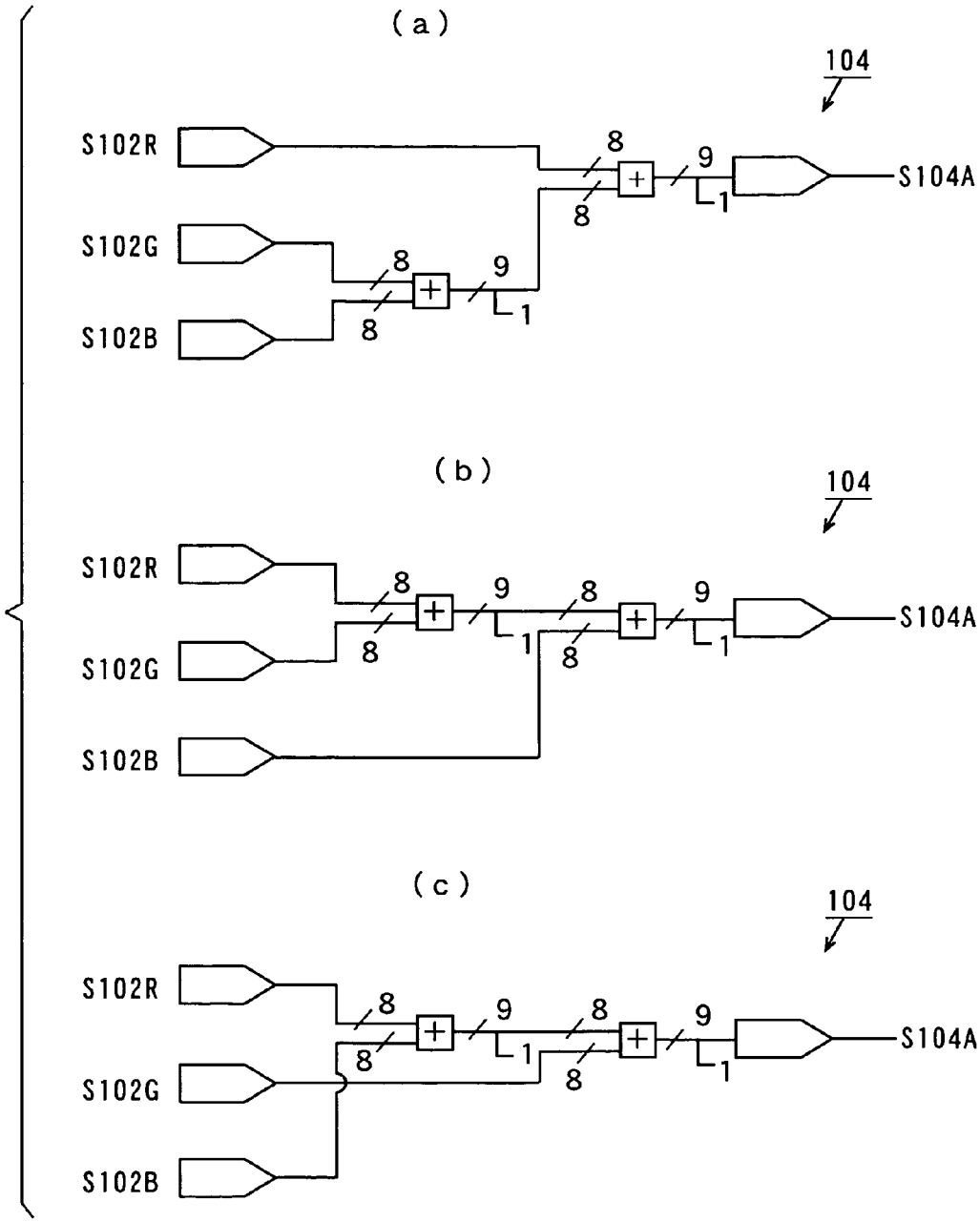
FIG. 3 is a diagram showing the configuration of the luminance signal generating circuit.

FIG. 3 is a diagram showing the configuration of the luminance signal generating circuit 104. FIG. 3(*a*) shows generation of a luminance signal S104A by mixing the digital image data S102R, S102G, S102B at a ratio of 2:1:1. FIG. 3(*b*) shows generation of a luminance signal S104A by mixing the digital image data S102R, S102G, S102B at a ratio of 1:1:2. FIG. 3(*c*) shows generation of a luminance signal S104A by mixing the digital image data S102R, S102G, S102B at a ratio of 1:2:1. In this embodiment, the digital image data S102R, S102G, S102B are 8-bit digital signals.

The luminance signal generating circuit 104 in FIG. 3(*a*) mixes the green digital image data S102G with the blue digital image data S102B to generate 9-bit digital image data. The circuit 104 then mixes the 8 high-order bits of digital image data of the 9-bit digital image data and the red digital image data S102R to generate 9-bit digital image data. The circuit 104 outputs the 8 high-order bits of digital image data of the 9-bit digital image data as a luminance signal S104A.

The luminance signal generating circuit 104 in FIG. 3(*b*) mixes the red digital image data S102R with the green digital image data S102G to generate 9-bit digital image data. The circuit 104 then mixes the 8 high-order bits of digital image data of the 9-bit digital image data with the blue digital image data S102B to generate 9-bit digital image data. The circuit 104 outputs the 8 high-order bits of digital image data of the 9-bit digital image data as a luminance signal S104A.

The luminance signal generating circuit 104 in FIG. 3(*c*) mixes the red digital image data S102R with the blue digital image data S102B to generate 9-bit digital image data. The circuit 104 then mixes the 8 high-order bits of digital image data of the 9-bit digital image data with the green digital image data S102G to generate 9-bit digital image data. The circuit 104 outputs the 8 high-order bits of digital image data of the 9-bit digital image data as a luminance signal S104A.

While the foregoing example illustrates the configuration of the luminance signal generating circuit 104 for generating a luminance signal S104A from the digital image data S102R, S102G, S102B, the configuration of the luminance signal generating circuit 104 for generating a luminance signal S104B from the digital image data S103R, 103G, 103B is also the same as this configuration.

As described above, while generation of an 8-bit luminance signal S104A with 256 levels of gray by mixing the digital image data S102R, S102G, S102B at 1:1:1 requires adders and multipliers for multiplying by 0.3333, mixing the digital image data S102R, S102G, S102B at any of the ratios 2:1:1, 1:1:2, and 1:2:1 requires only the adders, thereby allowing a smaller size of the circuit.

Figure 4:
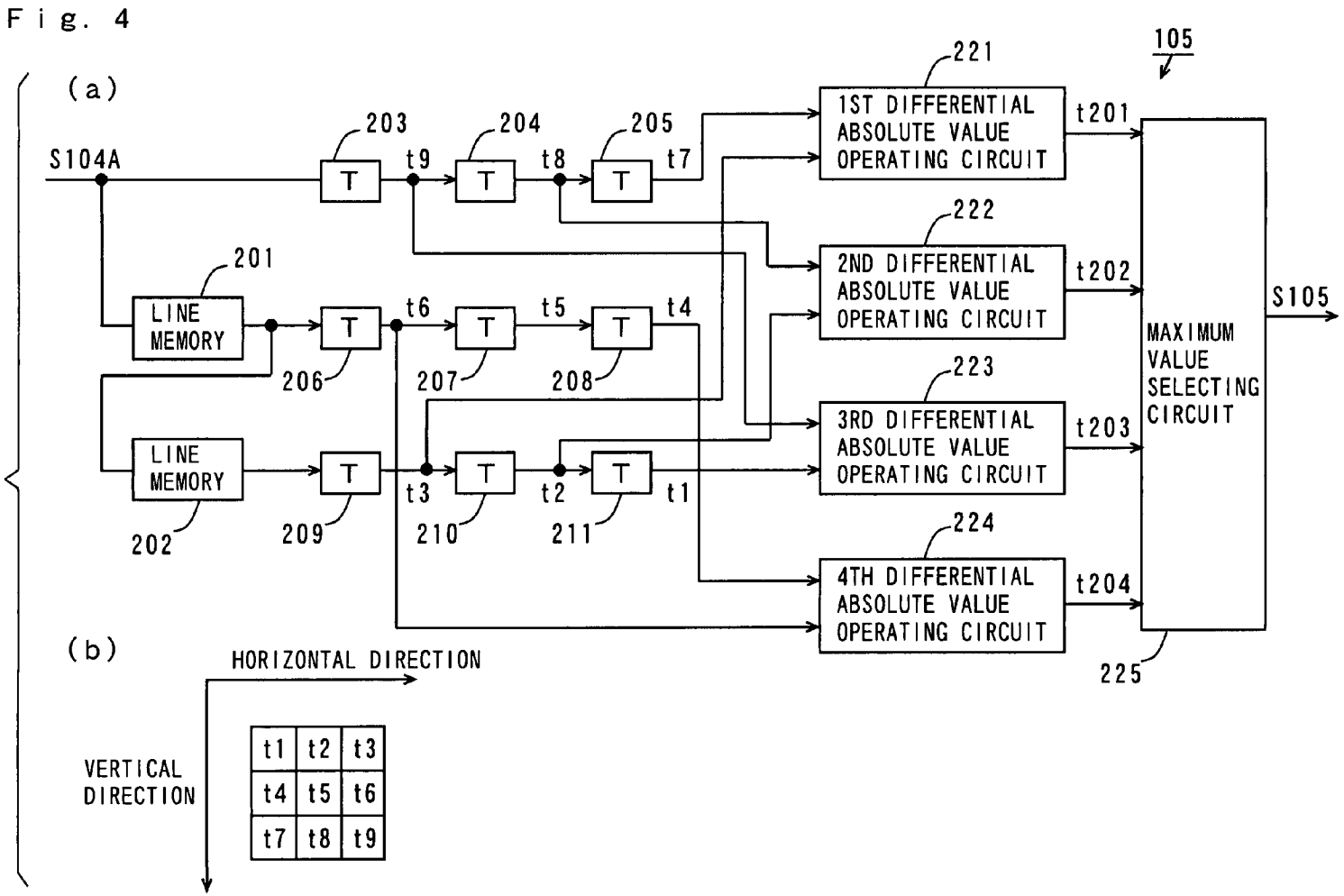
FIG. 4 is an illustrative diagram showing an example of the luminance gradient detecting circuit.

FIG. 4 is an illustrative diagram showing an example of the luminance gradient detecting circuit 105. FIG. 4(*a*) shows the configuration of the luminance gradient detecting circuit 105, and FIG. 4(*b*) shows relationships between pixel data and a plurality of pixels.

The luminance gradient detecting circuit 105 in FIG. 4 includes line memories 201, 202, 1 pixel clock delay circuits (hereinafter referred to as delay circuits) 203 to 211, a first differential absolute value operating circuit 221, a second differential absolute value operating circuit 222, a third differential absolute value operating circuit 223, a fourth differential absolute value operating circuit 224, and a maximum value selecting circuit 225.

Note that the configuration of the luminance gradient detecting circuit 106 in FIG. 1 is the same as that of the luminance gradient detecting circuit 105.

In FIG. 4(*a*), a luminance signal S104A is input to the line memory 201. The line memory 201 delays the luminance signal S104A by one line, and supplies the signal to the line memory 202 and the delay circuit 206. The line memory 202 delays the luminance signal by one line that has been delayed by one line in the line memory 201, and supplies the signal to the delay circuit 209.

The delay circuit 203 delays the input luminance signal S104A by one pixel, and supplies the signal as image data t9 to the delay circuit 204 and the third differential absolute value operating circuit 223. The delay circuit 204 delays the received image data t9 by one pixel, and supplies the data as image data t8 to the delay circuit 205 and the second differential absolute value operating circuit 222. The delay circuit 205 delays the received image data t8 by one pixel, and supplies the data as image data t7 to the first differential absolute value operating circuit 221.

The delay circuit 206 delays the luminance signal by one pixel that has been delayed by one line in the line memory 201, and supplies the signal as image data t6 to the delay circuit 207 and the fourth differential absolute value operating circuit 224. The delay circuit 207 delays the received image data t6 by one pixel, and supplies the data as image data t5 to the delay circuit 208. The delay circuit 208 delays the received image data t5 by one pixel, and supplies the data as image data t4 to the fourth differential absolute value operating circuit 224.

The delay circuit 209 delays the luminance signal by one pixel that has been delayed by two lines in the line memories 201, 202, and supplies the signal as image data t3 to the delay circuit 210 and the first differential value operating circuit 221. The delay circuit 210 delays the received image data t3 by one pixel, and supplies the data as image data t2 to the delay circuit 211 and the second differential absolute value operating circuit 222. The delay circuit 211 delays the received image data t2 by one pixel, and supplies the data as image data t1 to the third differential absolute value operating circuit 223.

The first differential absolute value operating circuit 221 calculates a differential signal t201 representing the absolute value of a difference between the obtained image data t3 and t7, and supplies the differential signal t201 to the maximum value selecting circuit 225. The second differential absolute value operating circuit 222 calculates a differential signal t202 representing the absolute value of a difference between the obtained image data t2 and t8, and supplies the differential signal t202 to the maximum value selecting circuit 225. The third differential absolute value operating circuit 223 calculates a differential signal t203 representing the absolute value of a difference between the obtained image data t1 and t9, and supplies the differential signal t203 to the maximum value selecting circuit 225. The fourth absolute value operating circuit 224 calculates a differential signal t204 representing the absolute value of a difference between the obtained image data t4 and t6, and supplies the differential signal t204 to the maximum value selecting circuit 225.

The maximum value selecting circuit 225 selects a differential signal with the greatest value of the differential signals t201, t202, t203, t204 supplied from the first, second, third, and fourth differential absolute value operating devices 221 to 224, respectively, and supplies the differential signal as a luminance gradient signal S105 for the current field to the motion detecting circuit 107 of FIG. 1.

As shown in FIG. 4(*b*), the luminance gradient detecting circuit 105 is capable of extracting the image data t1 to t9 for nine pixels from the luminance signal S104A by means of the line memories 201, 201 and the delay circuits 203 to 211.

The image data t5 represents the luminance of a pixel of interest. The image data t1, t2, t3 represent the luminances of pixels at the upper left, above, and at the upper right, respectively, of the pixel of interest. The image data t4 and t6 represent the luminances of pixels at the left and right, respectively, of the pixel of interest. The image data t7, t8, t9 represent the luminances of pixels at the lower left, below, and at the lower right, respectively, of the pixel of interest.

The gradient signal t201 indicates a luminance gradient between the image data t3, t7 in FIG. 4(*b*) (hereinafter referred to as a luminance gradient in the right diagonal direction), the gradient signal t202 indicates a luminance gradient between the image data t2, t8 (hereinafter referred to as a luminance gradient in the vertical direction), the gradient signal t203 indicates a luminance gradient between the image data t1, t9 (hereinafter referred to as a luminance gradient in the left diagonal direction), and the gradient signal t204 indicates a luminance gradient between the image data t4, t6 (hereinafter referred to as a luminance gradient in the horizontal direction). In the foregoing manner, the luminance gradients in the right diagonal direction, vertical direction, left diagonal direction, and horizontal direction with respect to the pixel of interest can be determined.

Although the method of determining the luminance gradient for the two pixels in each of the right diagonal direction, vertical direction, left diagonal direction, and horizontal direction is used in this embodiment, other methods are also possible. The luminance gradient for one pixel may be determined by dividing the luminance gradient signal S105 or S106 by two. Alternatively, a method may be used in which a difference between the image data t5 and the image data t1 to t4 and a difference between the image data t5 and the image data t6 to t9 are each calculated, and the maximum value of the absolute values of the calculations is selected.

Note that the luminance gradient detecting circuit 106, which operates similarly to the luminance gradient detecting circuit 105, detects the luminance gradient signal S106 for the previous field from the luminance signal S104B for the previous field, and supplies the luminance gradient signal S106 to the motion detecting circuit 107 in FIG. 1.

Figure 5:
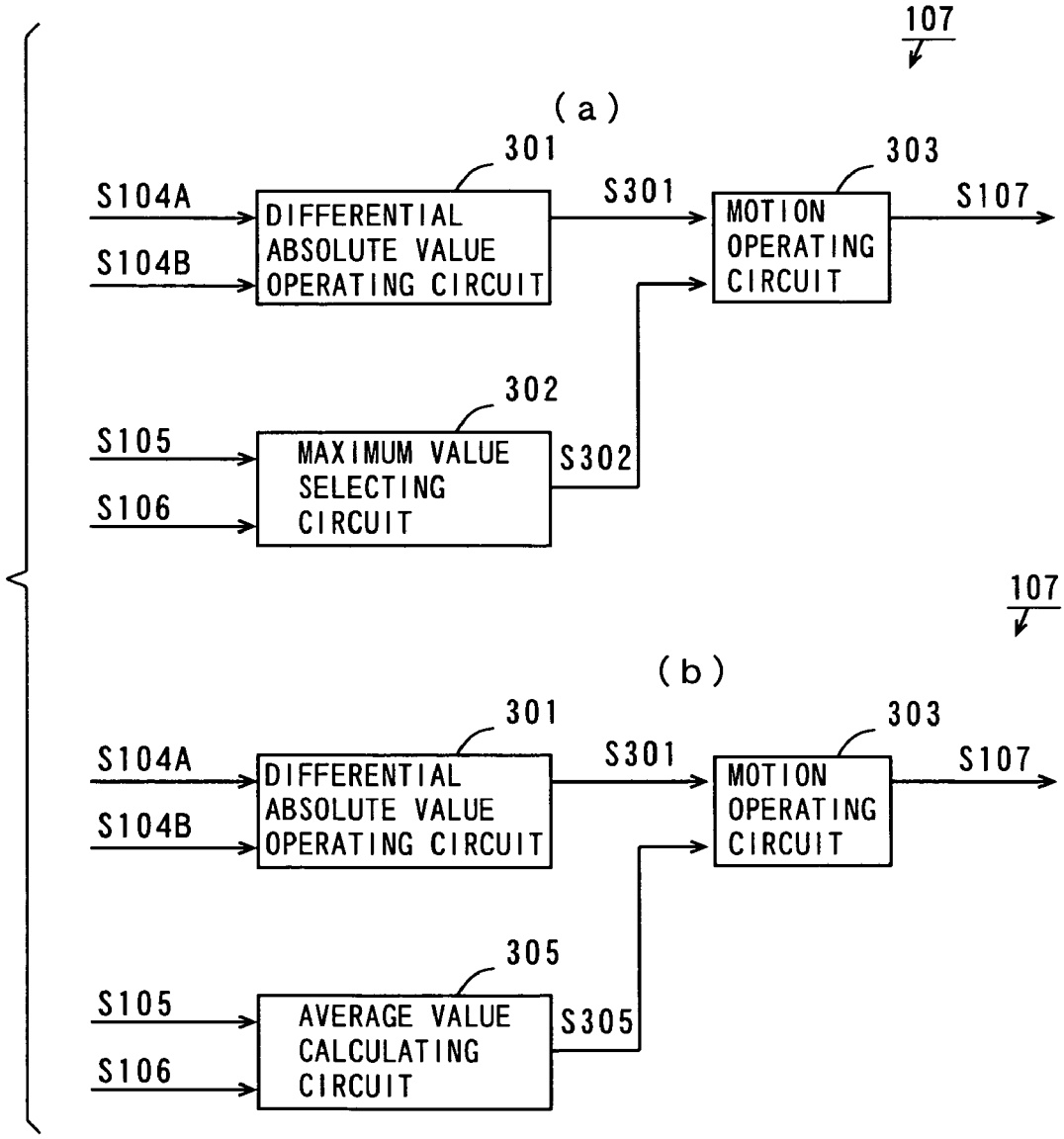
FIG. 5(*a*) is a block diagram showing an example of the configuration of the motion detecting circuit, and FIG. 5(*b*) is a block diagram showing another example of the configuration of the motion detecting circuit.

Now refer to FIG. 5(*a*) which is a block diagram showing an example of the configuration of the motion detecting circuit 107, and FIG. 5(*b*) which is a block diagram showing another example of the configuration of the motion detecting circuit 107. FIG. 5(*a*) shows the configuration of the motion detecting circuit 107 when outputting a minimum value of the amount of motion, and FIG. 5(*b*) shows the configuration of the motion detecting circuit 107 when outputting an average value of the amount of motion.

The motion detecting circuit 107 in FIG. 5(*a*) includes a differential absolute value operating circuit 301, a maximum value selecting circuit 302, and a motion operating circuit 303.

A luminance signal S104A for the current field and a luminance signal S104B for the previous field are input to the differential absolute value operating circuit 301. The differential absolute value operating circuit 301 with a line memory and two delay circuits delays the luminance signals S104A, S104B by one line and two pixels, and calculates the absolute value of a difference between the delayed luminance signals, thereby supplying the motion operating circuit 303 with the result as a variation signal S301 representing the amount of the change in the pixel of interest between the fields.

A luminance gradient signal S105 for the current field and a luminance gradient signal S106 for the previous field are input to the maximum value selecting circuit 302. The maximum value selecting circuit 302 selects the maximum value of the luminance gradient signal S105 for the current field and the luminance gradient signal S106 for the previous field, and supplies the value as a maximum luminance gradient signal S302 to the motion operating circuit 303.

The motion operating circuit 303 generates a motion detecting signal S107 by dividing the variation signal S301 by the maximum luminance gradient signal S302, and supplies the signal to the image data processing circuit 108 in FIG. 1.

The motion detecting signal S107 in FIG. 5(*a*) as mentioned here represents the minimum value of the amount of motion of the pixel of interest, since it is obtained by dividing the variation signal S301 by the maximum luminance gradient signal S302. The minimum value of the amount of motion of the pixel of interest represents the minimum amount of motion of the image between the previous field and the current field.

Next, the motion detecting circuit 107 in FIG. 5(*b*) includes an average value calculating circuit 305 instead of the maximum value selecting circuit 302 in the motion detecting circuit 107 in FIG. 5(*a*). Differences of the motion detecting circuit 107 in FIG. 5(*b*) from the motion detecting circuit 107 in FIG. 5(*a*) will now be described.

A luminance gradient signal S105 for the current field and a luminance gradient signal S106 for the previous field are input to the average value calculating circuit 305. The average value calculating circuit 305 selects the average value of the luminance gradient signal S105 for the current field and the luminance gradient signal S106 for the previous field, and supplies the average value as an average value luminance gradient signal S305 to the motion operating circuit 303.

The motion operating circuit 303 generates a motion detecting signal S107 by dividing a variation signal S301 by the average value luminance gradient signal S305, and supplies the signal to the image data processing circuit 108 in FIG. 1.

The motion detecting signal S107 in FIG. 5(*b*) as mentioned here represents the average value of the amount of motion of the pixel of interest, since it is obtained by dividing the variation signal S301 by the average value luminance gradient signal S305. The average value of the amount of motion of the pixel of interest represents the average amount of motion of an image between the previous field and the current field.

Next, representation of multiple levels of gray on the PDP 140 in FIG. 1 using the sub-field method will be described. When moving images are displayed on a screen of the PDP 140 by representing multiple levels of grayscale using the sub-field method, a false contour appears in the human eye. This false contour (hereinafter referred to as a dynamic false contour) is now described.

Figure 6:
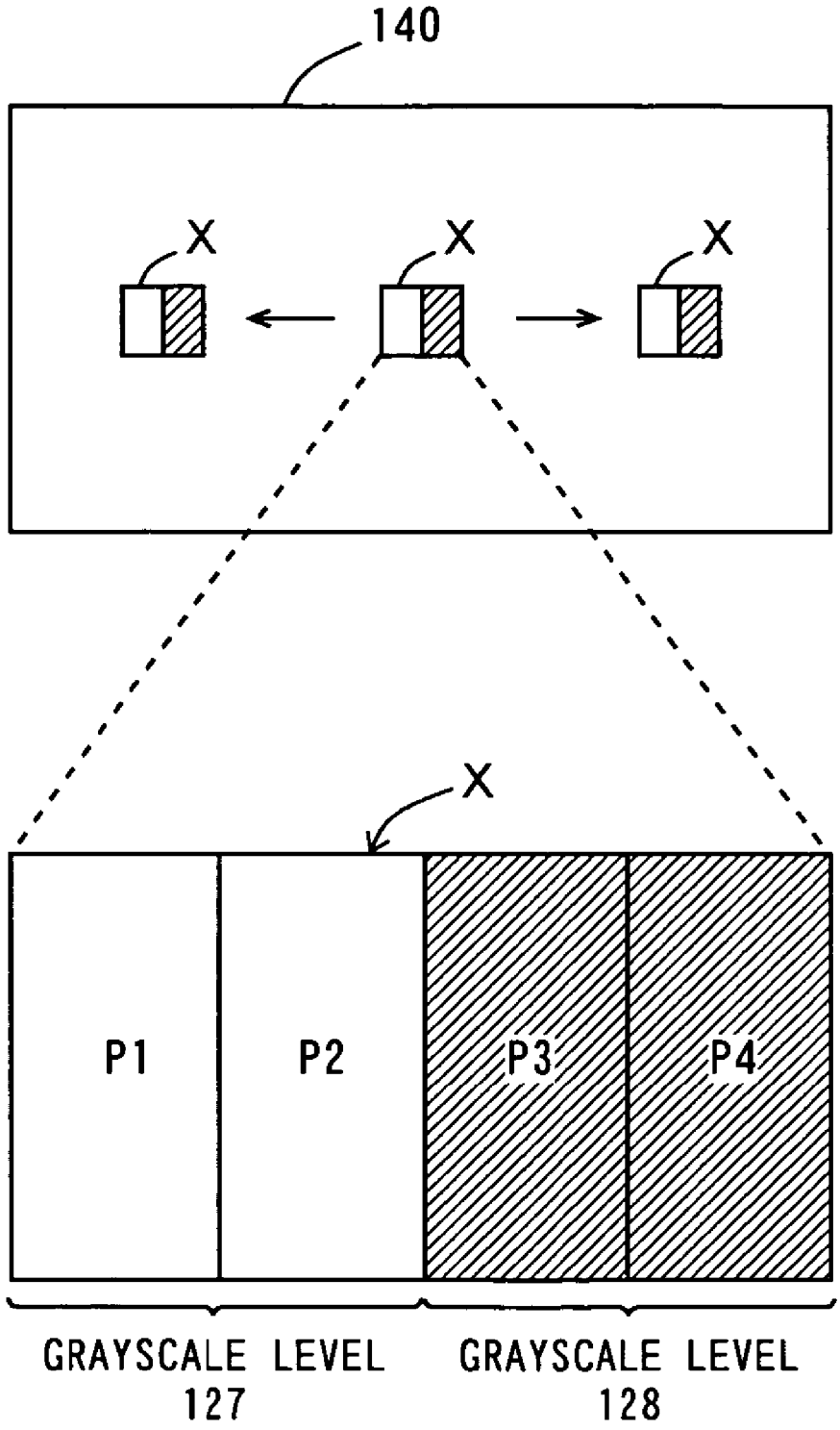
FIG. 6 is a diagram for illustrating the generation of a dynamic false contour noise.
Figure 7:
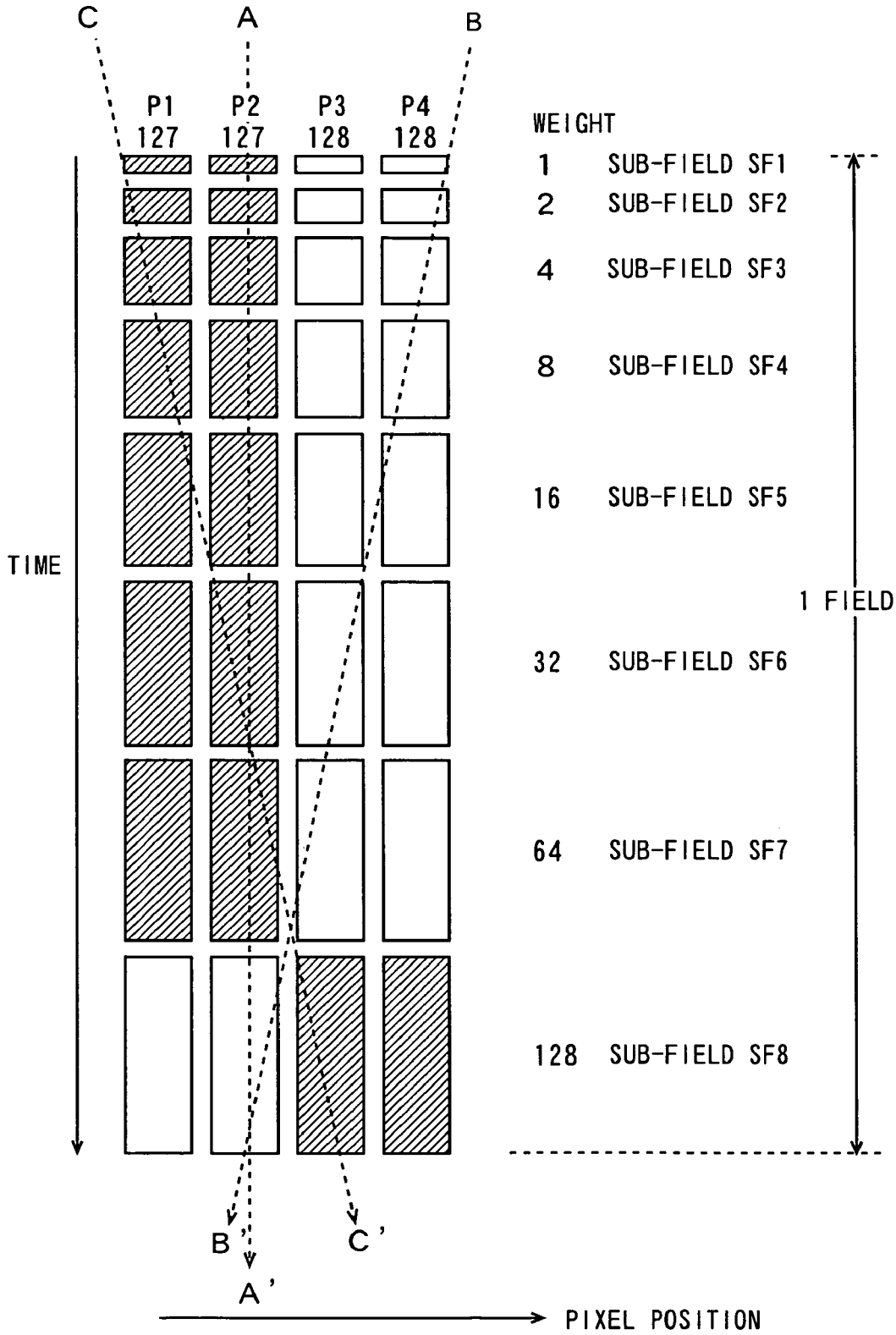
FIG. 7 is a diagram for illustrating a cause of the generation of a dynamic false contour noise.

FIG. 6 is a diagram for illustrating the generation of a false contour noise, and FIG. 7 is a diagram for illustrating a cause of the generation of a false contour noise. In FIG. 7, the abscissa represents the positions of pixels in the horizontal direction on the screen of PDP 140, and the ordinate represents the time direction. The hatched rectangles in FIG. 7 represent emission states of pixels in the sub-fields, and the outline rectangles represent non-emission states of pixels in the sub-fields.

The sub-fields SF1-SF8 in FIG. 7 are assigned brightness weights 1, 2, 4, 8, 16, 32, 64, and 128, respectively. By combinations of these sub-fields SF1-SF8, brightness levels (grayscale levels) can be adjusted in 256 steps from 0 to 255. Note, however, that the number of divided sub-fields, weights, and the like can be modified in various manners without being particularly limited to this example; for example, the sub-field SF8 may be divided into two, and the divided two sub-fields may each be assigned a weight of 64 in order to reduce dynamic false contours described below.

To begin with, as shown in FIG. 6, an image pattern X includes a pixel P1 and a pixel P2 with grayscale levels of 127, and adjacent pixel P3 and pixel P4 with grayscale levels of 128. When this image pattern X is displayed still on the screen of the PDP 140, the human eye is positioned in the direction A-A' as shown in FIG. 7. As a result, the human can perceive the original grayscale level of a pixel that is represented by the sub-fields SF1-SF8.

Next, when the image pattern X shown in FIG. 6 moves by an amount of two pixels in the horizontal direction on the screen of the PDP 140, the human eye moves in the direction B-B' or direction C-C', as shown in FIG. 7.

For example, when the human eye moves along the direction B-B', the human perceives the sub-fields SF1-SF5 for the pixel P4, the sub-fields SF6, SF7 for the pixel P3, and the sub-field SF8 for the pixel P2. This causes the human to integrate these sub-fields SF1-SF8 in time, and perceive the grayscale level as zero.

On the other hand, when the human eye moves along the direction C-C', the human perceives the sub-fields SF1-SF5 for the pixel P1, the sub-fields SF6, SF7 for the pixel P2, and the sub-field SF8 for the pixel P3. This causes the human to integrate these sub-fields SF1-SF8 in time, and perceive the grayscale level as 255.

As discussed above, the human perceives a grayscale level substantially different from the original grayscale level (127 or 128), and perceives this different grayscale level as a dynamic false contour.

While the embodiment describes the grayscale levels of adjacent pixels as 127 and 128, a noticeable dynamic false contour is observed also with other grayscale levels; for example, when the grayscale levels of adjacent pixels are 63 and 64 or 191 and 192.

When pixels of close grayscale levels are adjacent in this manner, there is a great change in the pattern of emission sub-fields although the change in the grayscale level is small, causing the appearance of a noticeable dynamic false contour.

The dynamic false contour appearing when a moving image is displayed on a PDP is called a false contour noise (refer to Institute of Television Engineers of Japan Technical Report. "False Contour Noise Observed in Display of Pulse Width Modulated Moving Images", Vol. 19, No. 2, IDY 95-21, pp. 61-66), and becomes a cause of degradation in the image quality of the moving image.

Figure 8:
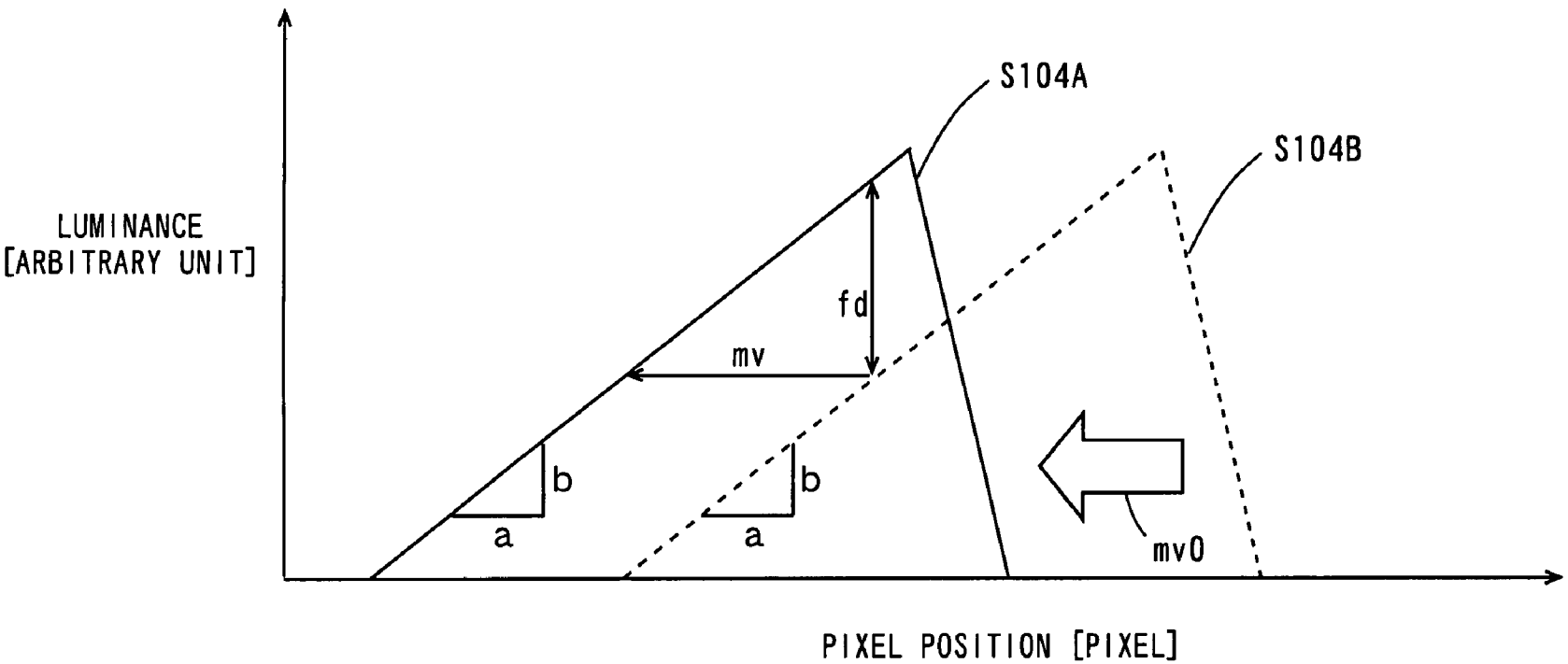
FIG. 8 is an illustrative diagram of the operating principle of the motion detecting circuit in FIG. 1.

Now refer to FIG. 8 which is an illustrative diagram of the operating principle of the motion detecting circuit 107 in FIG. 1. In FIG., 8, the abscissa represents the positions of pixels in the PDP 140, and the ordinate represents the luminance. Image data, although inherently two-dimensional data, is herein described as one-dimensional data as we focus only on the pixels in the horizontal direction of the image data.

In FIG. 8, the dotted line represents the luminance distribution of an image displayed by a luminance signal S104B for the previous field, and the solid line represents the luminance distribution of an image displayed by a signal S104A for the current field. Accordingly, an image moves from the dotted line to the solid line (direction of the arrow mv0) within one field period.

Note also that in FIG. 8, the amount of motion of the image is represented by mv (pixel/field), and the luminance difference between the fields is represented by fd (arbitrary unit/field). The luminance gradient between the luminance signal S104B for the previous field and the luminance signal S104A for the current field is represented by (b/a) [arbitrary unit/pixel]. The arbitrary unit herein denotes an arbitrary unit in proportion to the unit of luminance.

The value of this luminance gradient (b/a) [arbitrary unit/pixel] is equal to the value obtained by dividing the luminance difference fd (arbitrary unit/field) between the fields by the amount of motion mv (pixel/field) of the image. Hence, the relation between the amount of motion mv of the image and the luminance difference fd between the fields is expressed by an equation below:

$$fd/mv=(b/a) \tag{1}$$

The amount of motion mv of the image is accordingly expressed by an equation below:

$$mv=fd/(b/a) \tag{2}$$

Based on the foregoing equations, the amount of motion mv of the image is a value of the luminance difference fd between the fields divided by the luminance gradient (b/a)

Note that in this embodiment, when calculating the amount of motion mv of the image using the luminance gradient (b/a) for two pixels as shown in FIG. 4, it is necessary to double the amount of motion mv of the image obtained by the foregoing equation (2) for correction.

Although the maximum luminance gradient is obtained through the configuration of FIG. 4, the direction of the maximum luminance gradient is not necessarily parallel to the motion of an image, which is why the motion detecting signal S107 is derived representing at least what number of pixels the image has moved. Accordingly, when assuming that the image has moved vertically to the maximum luminance gradient, the luminance difference fd between the fields is approximately zero, making the value of the motion detecting signal S107 approximately zero, although in fact the image has moved greatly. Such a problem, however, does not arise when the eye moves in the direction of smaller luminance gradient (b/a) values, since in that case a false contour is hardly generated.

Moreover, reducing false contours does not require precise information such as a motion vector or a direction of motion, but only a rough understanding of the amount of motion of an image. Therefore, a mere difference between the directions of a luminance gradient and the motion of an image or a certain degree of variations in the amount of motion will do no harm to reducing dynamic false contours.

Next, image data processing performed by the image data processing circuit 108 in FIG. 1 will be described.

Figure 9:
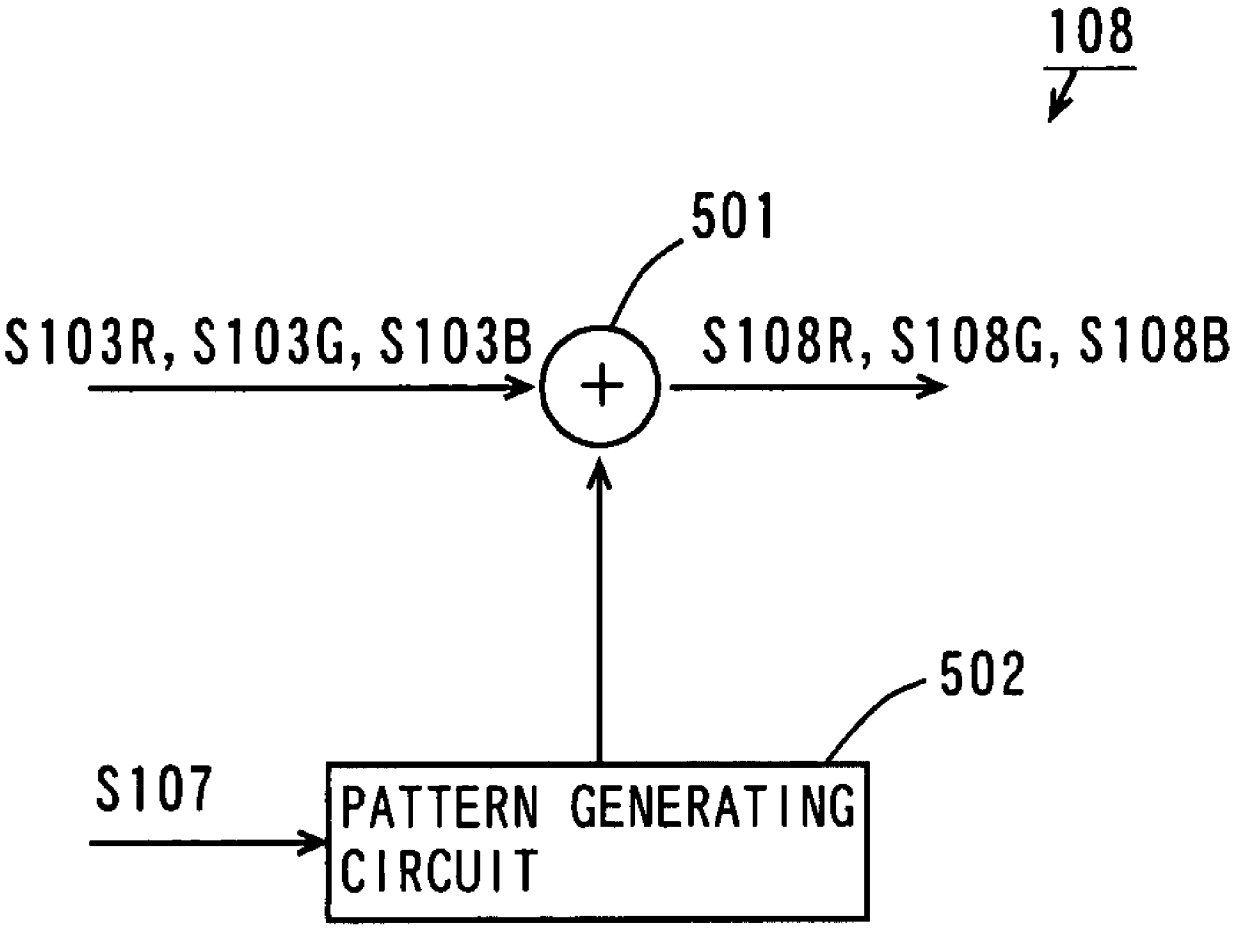
FIG. 9 is a block diagram showing an example of the configuration of the image data processing circuit.
Figure 10:
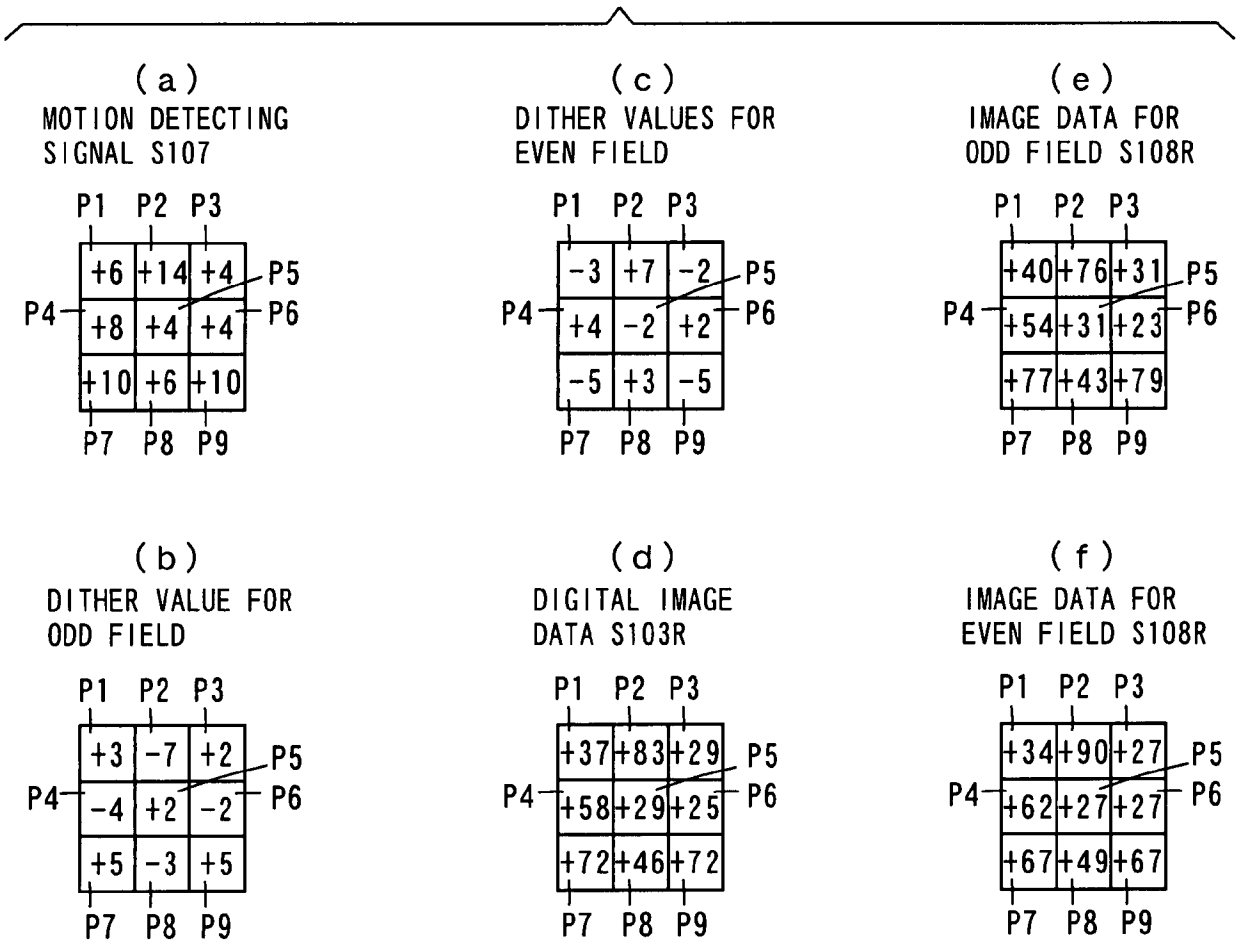
FIG. 10 is a diagram for illustrating image processing by a pixel diffusion method according to the amount of motion of an image.
Figure 11:
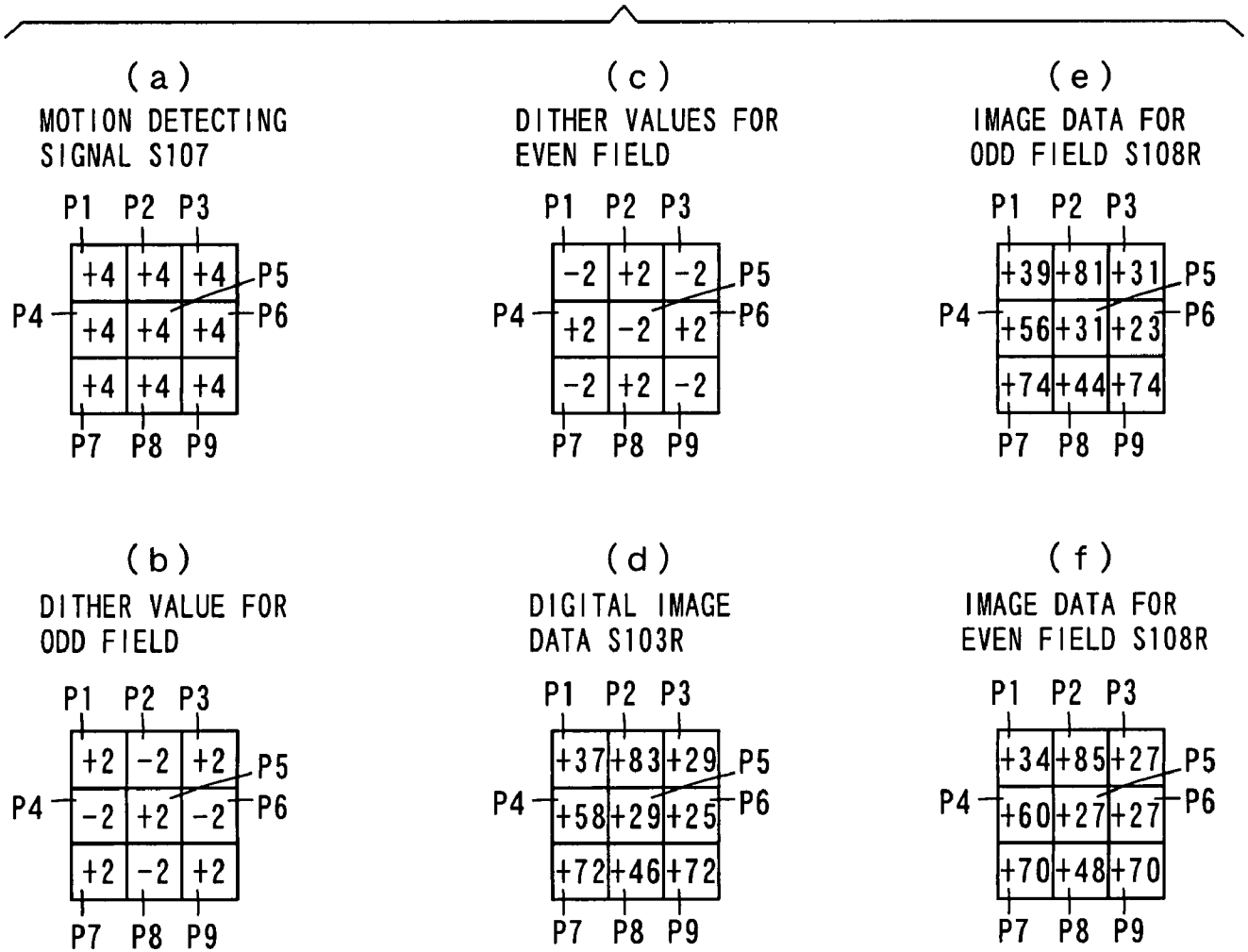
FIG. 11 is a diagram for illustrating image processing by a pixel diffusion method according to the amount of motion of an image.
Figure 12:
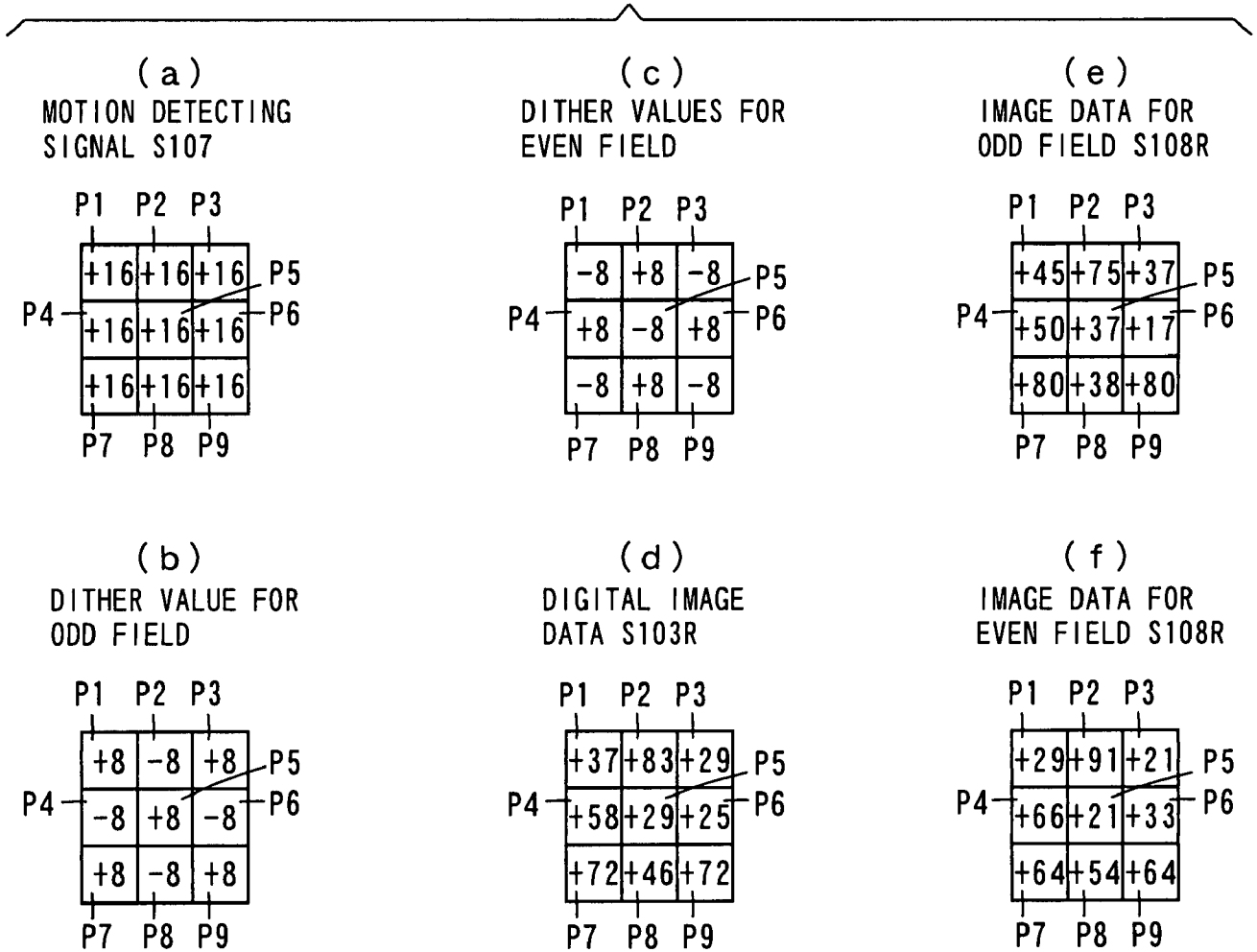
FIG. 12 is a diagram for illustrating image processing by a pixel diffusion method according to the amount of motion of an image.

FIG. 9 is a block diagram showing an example of the configuration of the image data processing circuit 108. The image data processing circuit 108 in this embodiment diffuses the digital image data S103R, S103G, S103G when the value of the motion detecting signal S107 is great. This makes a false contour noise difficult to be perceived, and therefore improves image quality. In this embodiment, a pattern dither method, a general method of pixel diffusion, (The Institute of Electronics, Information and Communication Engineers National Conference Electronic Society. "Considerations As To Reducing Dynamic False Contours in PDPs", C-408, p 66, 1996) is used, as shown in FIG. 10, FIG. 11, and FIG. 12.

The image data processing circuit 108 of FIG. 9 includes a modulating circuit 501 and a pattern generating circuit 502.

The digital image data S103R, S103G, S103B, which have been delayed by one field in the field delay circuit 103 of FIG. 1, are input to the modulating circuit 501 of FIG. 9.

The motion detecting signal S107 is input to the pattern generating circuit 502 from the motion detecting circuit 107. The pattern generating circuit 502 stores a plurality of sets of dither values corresponding to amounts of motion of an image. The pattern generating circuit 502 supplies the modulating circuit 501 with positive and negative dither values corresponding to the values of the motion detecting signal S107. The modulating circuit 501 adds the positive and negative dither values alternately to the digital image data S103R, S103G, S103B for each field, and outputs the digital image data S108R, S108G, S108B representing the results of addition. In this case, dither values with opposite signs are added to adjacent pixels in the horizontal and vertical directions.

Detailed operations of the pattern generating circuit 502 will now be described.

FIG. 10, FIG. 11, and FIG. 12 are diagrams each showing exemplary operations of the image data processing circuit 108. FIG. 10 shows operations of the image data processing circuit 108 when there is a change for each pixel in the amount of motion of an image, FIG. 11 shows operations when the amount of motion of an image is small and uniform, and FIG. 12 shows operations when the amount of motion of an image is great and uniform. While image data processing for the digital image data S103R is herein described, image data processing for the digital image data S103G and digital image data S103B is also the same.

In each of FIG. 10, FIG. 11, and FIG. 12, (*a*) represents values of the motion detecting signal S107 corresponding to nine pixels P1 to P9; (*b*) represents dither values corresponding to the nine pixels P1 to P9 in an odd field; (*c*) represents dither values corresponding to the nine pixels P1 to P9 in an even field; (*d*) represents values of the digital image data S103R corresponding to the nine pixels P1 to P9; (*e*) represents values of the digital image data S108R corresponding to the nine pixels P1 to P9 in an odd field; and (*f*) represents values of the digital image data S108R corresponding to the nine pixels P1 to P9 in an even field.

As an example, consider the pixel P1 as a pixel of interest. In this case, as shown in FIG. 10(*a*), the value of the motion detecting signal S107 for the pixel P1 is "+6". Similarly, as shown in FIG. 10(*d*), the value of the digital image data S103R for the pixel P1 is "+37". As shown in FIG. 10(*b*), the dither value for the pixel P1 is "+3" in an odd field. Accordingly, the value of the digital image data S108R for the pixel P1 is "+40", as shown in FIG. 10(*e*). In addition, as shown in FIG. 10(*c*), the dither value for the pixel P1 is "−3" in an even field. Accordingly, as shown in FIG. 10(*f*), the value of the digital image data S108R for the pixel P1 is "+34". This also applies to the other pixels P2 to P9 being pixels of interest.

Next, as shown in FIG. 11, when the amount of motion of an image is small and uniform, values of the motion detecting signal S107 for the pixels P1-P9 are "+4", and dither values for the pixels P1-P9 in an odd field and an even field are "+2" and "−2" alternately.

Further, as shown in FIG. 12, when the amount of motion of an image is great and uniform, values of the motion detecting signal S107 for the pixels P1-P9 are "+16", and dither values for the pixels P1-P9 in an odd field and an even field are "+8" and "−8" alternately.

When in consecutive luminance is provided between adjacent pixels in the vertical and horizontal directions as well as the time direction, the human eye perceives the original luminance as the average luminance of these pixels, thus making a false contour noise difficult to be perceived.

Dither values are set to be small when the amount of motion of an image is small, and set to be great when the amount of motion of an image is large.

This diffusion process that is applied to a necessary area in a necessary magnitude enables a reduction in dynamic false contours without increasing a perception of noise.

As described above, in the image display apparatus 100 according to the first embodiment, a plurality of gradient values are detected based on the video signal S104A for the current field and the video signal S104B for the previous field, followed by the determination of a luminance gradient of an image based on the plurality of gradient values. In this case, the luminance gradient is determined based on the maximum value of the plurality of gradient values or the average value thereof. This results in the determination of a minimum amount of motion of the image or an average amount of motion of an image.

Moreover, in the image display apparatus 100 according to the first embodiment, the dither method is performed based on the amount of motion of an image without using an image motion vector, enabling a more effective reduction of dynamic false contours.

Since the possibility of the generation of a dynamic false contour is higher with a greater amount of motion of an image, grayscale levels unlikely to cause a dynamic false contour may be selected based on the amount of motion of the image. This results in an even more effective reduction of dynamic false contours.

This selection of grayscale levels may involve restricting the number of grayscale levels used while selecting grayscale levels unlikely to cause a dynamic false contour, and compensating for grayscale levels that cannot be displayed by combinations of sub-fields, using either or both of the pattern dither method and the error diffusion method. This results in an increased number of grayscale levels and still more effective reduction of dynamic false contours.

For example, in order to reduce dynamic false contours, the difference between an unrepresentable grayscale level that is not used and a representable grayscale level may be diffused temporally and/or spatially, so as to represent the unrepresentable grayscale level equivalently using the representable grayscale level. This results in an increased number of grayscale levels and an even more effective reduction of dynamic false contours.

Although the pattern dither process is performed in this embodiment as image data processing in the image data processing circuit 108, other pixel diffusion process or error diffusion process may be performed as image data processing based on the amount of motion of an image. The image data processing circuit 108 may also perform other suitable processes based on the amount of motion of an image.

In the image display apparatus 100 according to the first embodiment, the sub-field processing circuit 109 and the PDP 140 correspond to a grayscale display unit; the one-field delay circuit 103 corresponds to a field delay unit; the luminance gradient detecting circuits 105, 106 correspond to a luminance gradient detector; the differential absolute value operating circuit 301 in the motion detecting circuit 107 corresponds to a differential calculator; the motion operating circuit 303 in the motion detecting circuit 107 corresponds to a motion amount calculator; the first, second, third, and fourth differential absolute value operating circuits 221, 222, 223, 224 and the maximum value selecting circuit 225 correspond to a gradient determiner; the average value calculating circuit 305 corresponds to an average gradient determiner; the maximum value selecting circuit 302 corresponds to a maximum gradient determiner; the luminance signal generating circuit 104 corresponds to a luminance signal generator; the line memories 201, 202, the delay circuits 203 to 211, the first to fourth differential absolute value operating circuits 221 to 224, and the maximum value selecting circuit 225 correspond to a gradient value detector; the image data processing circuit 108 corresponds to an image processor; and the modulating circuit 501 and the pattern generating circuit 502 corresponds to a diffusion processor.

Second Embodiment

An image display apparatus according to a second embodiment will now be described.

Figure 13:
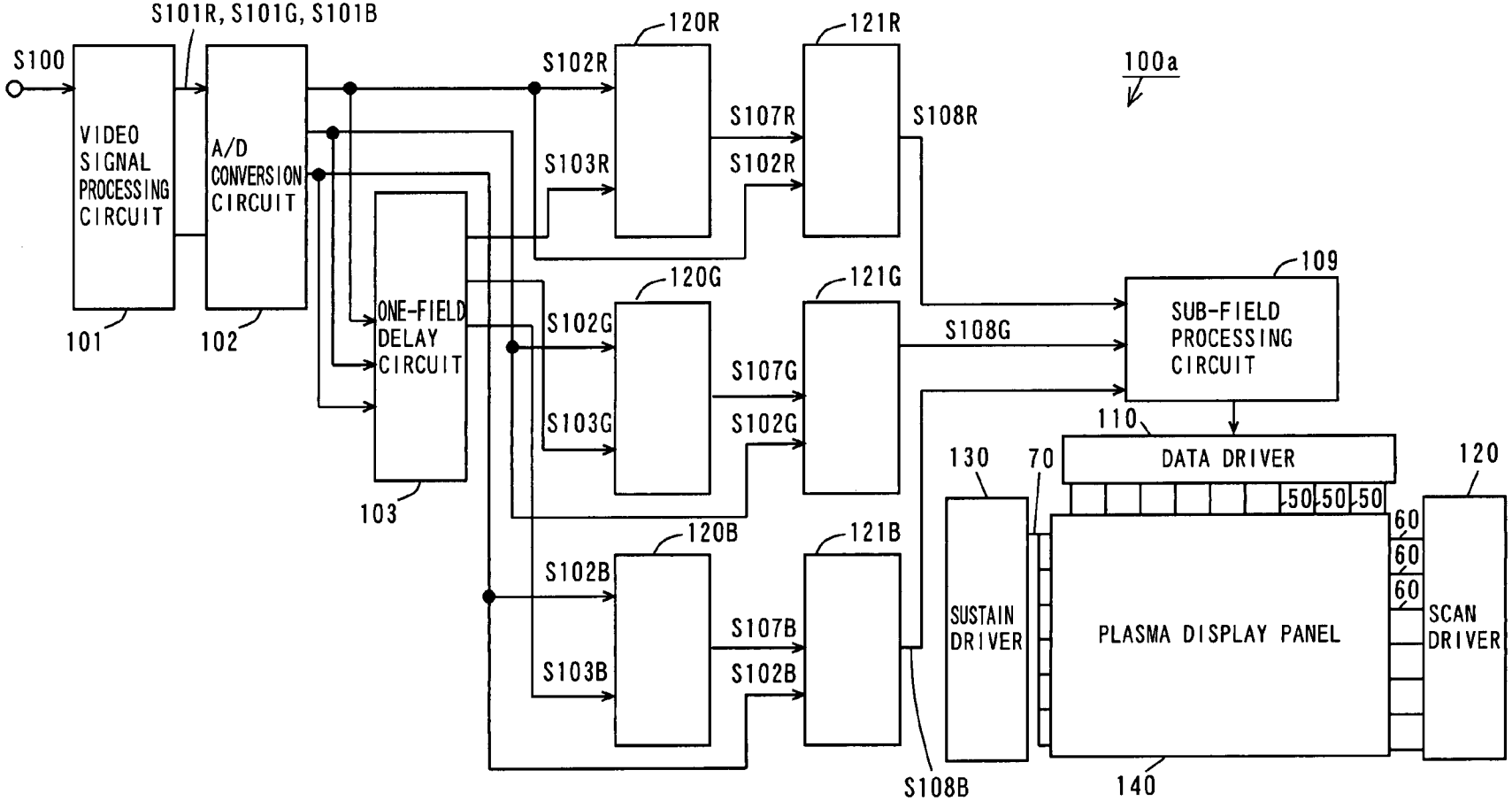
FIG. 13 is a diagram showing the configuration of an image display apparatus according to a second embodiment.

FIG. 13 is a diagram showing the configuration of an image display apparatus according to the second embodiment. The configuration of the image display apparatus 100*a* according to the second embodiment is different from that of the image display apparatus 100 according to the first embodiment as follows.

Instead of the luminance signal generating circuit 104, luminance gradient detecting circuits 105, 106, the motion detecting circuit 107, and the image data processing circuit 108 of the image display apparatus 100 in FIG. 1, the image display apparatus 100*a* shown in FIG. 13 comprises a red signal circuit 120R, a green signal circuit 120G, a blue signal circuit 120B, a red signal image data processing circuit (hereinafter referred to as a red image data processing circuit) 121R, a green signal image data processing circuit (hereinafter referred to as a green image data processing circuit) 121G, and a blue signal image data processing circuit (hereinafter referred to as a blue image data processing circuit) 121B.

The A/D conversion circuit 102 in FIG. 13 converts analog video signals S101R, S101G, S101B to digital image video data S102R, S102G, S102B, and supplies the digital image data S102R to the red signal circuit 120R, red image data processing circuit 121R, and one-field delay circuit 103, supplies the digital image data S102G to the green signal circuit 120G, green image data processing circuit 121G, and one-field delay circuit 103, and supplies the digital image data S102B to the blue signal circuit 120B, blue image data processing circuit 121B, and one-field delay circuit 103.

The one-field delay circuit 103 delays the digital image data S102R, S102G, S102B by one field using a field memory incorporated therein, and supplies the digital image data S103R to the red signal circuit 120R, the digital image data S103G to the green signal circuit 120G, and the digital image data S103B to the blue signal circuit 120B.

The red signal circuit 120R detects a red motion detecting signal S107R from the digital image data S102R, S103R, and supplies the signal to the red image data processing circuit 121R. The green signal circuit 120G detects a green motion detecting signal S107G from the digital image data S102G, S103G, and supplies the signal to the green image data processing circuit 121G.

The blue signal circuit 120B detects a blue motion detecting signal S107B from the digital image data S102B, S103B, and supplies the signal to the blue image data processing circuit 121B.

The red image data processing circuit 121R performs image data processing on the digital image data S102R based on the red motion detecting signal S107R, and supplies red image data S108R to the sub-field processing circuit 109.

The green image data processing circuit 121G performs image data processing on the digital image data S102G based on the green motion detecting signal S107G, and supplies green image data S108G to the sub-field processing circuit 109.

The blue image data processing circuit 121B performs image data processing on the digital image data S102B based on the blue motion detecting signal S107B, and supplies blue image data S108B to the sub-field processing circuit 109.

The sub-field processing circuit 109 converts the image data S108R, S108G, S108B to sub-field data for each pixel, and supplies the sub-field data to the data driver 110.

The data driver 110 selectively applies write pulses to the plurality of data electrodes 50 based on the sub-field data that is supplied from the sub-field processing circuit 109. The scan driver 120 drives each scan electrode 60 based on a timing signal that is supplied from a timing pulse generating circuit (not shown), while the sustain driver 130 drives the sustain electrodes 70 based on a timing signal supplied from the timing pulse generating circuit (not shown). This allows an image to be displayed on the PDP 140.

Figure 14:
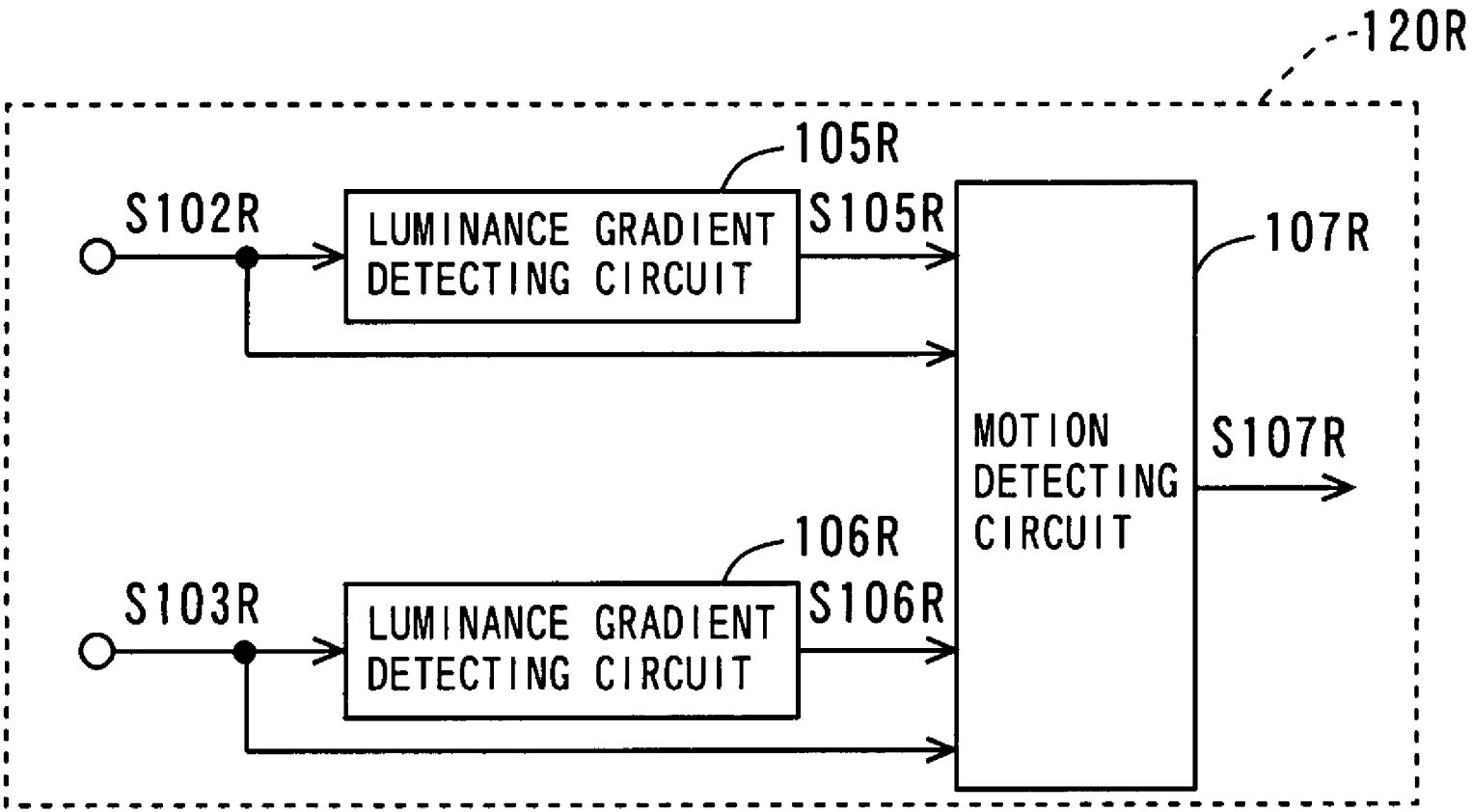
FIG. 14 is a block diagram showing the configuration of the red signal circuit.

Next, the configuration of the red signal circuit 120R will be described. FIG. 14 is a block diagram showing the configuration of the red signal circuit 120R.

The digital image data S102R is input to a luminance gradient detecting circuit 105R in the red signal circuit 120R in FIG. 14. The luminance gradient detecting circuit 105R detects a luminance gradient of the digital image data S102R, and supplies the result as a luminance gradient signal S105R to the motion detecting circuit 107R.

Similarly, the digital image data 103R is input to the luminance gradient detecting circuit 106R. The luminance gradient detecting circuit 106 detects a luminance gradient of the digital image data S102R, and supplies the result as a luminance gradient signal S106R to the motion detecting circuit 107R.

The motion detecting circuit 107R generates the red motion detecting signal S107R from the luminance gradient signals S105R, S106R and digital image data S102R, S103R, and supplies the signal to the red image data processing circuit 121R.

Note that the configurations of the green signal circuit 120G, 120B are the same as the configuration of the red signal circuit 120R.

As described above, the image display apparatus 100*a* according to the second embodiment is capable of detecting the luminance gradients and luminance differences between the red signal S102R for the current field and the red signal S103R for the previous field, between the green signal S102G for the current field and the green signal S103 for the previous field, and between the blue signal S102B for the current field and the blue signal S103B for the previous field, respectively. This allows the amount of motion of the image for each color to be calculated according to color.

In addition, the image display apparatus 100*a* according to the second embodiment is capable of obtaining the amount of motion of the image corresponding to the signal of each color by calculating the ratio of the luminance difference to the luminance gradient between the red signal S102R for the current field and the red signal S103R for the previous field, the ratio of the luminance difference to the luminance gradient between the green signal S102R for the current field and the green signal S103R for the previous field, and the ratio of the luminance difference to the luminance gradient between the blue signal S102B for the current field and the blue signal S103B for the previous field, respectively. This obviates the need to provide many line memories and operating circuits, allowing the amount of motion of the image for each color to be calculated through a simple structure.

In the image display apparatus 100*a* according to the second embodiment, the sub-field processing circuit 109 and the PDP 140 correspond to a grayscale display unit; the one-field delay circuit 103 corresponds to a field delay unit; the luminance gradient detecting circuits 105R, 105G, 105B, 106R, 106G, 106B correspond to a color signal gradient detector; the motion detecting circuits 107R, 107G, 107B correspond to a color signal differential calculator; and the image data processing circuit 108 corresponds to an image processor.

Although the foregoing first embodiment and second embodiment describe each circuit as being composed of hardware, each circuit may also be composed of software. Moreover, although the above-described image data processing is performed using the digital image data S103R, S103G, S103B for the previous field, image data processing may be performed using the digital image data S102R, S102G, S102B for the current field.

The invention claimed is:

1. An image display apparatus that displays an image based on a video signal, comprising:

a grayscale display unit that divides said video signal for each field into a plurality of sub-fields, each of which is weighted according to the duration of time or number of pulses, and temporally superimposes said plurality of sub-fields for display to provide a grayscale representation;

a field delay unit that delays a video signal for a current field by one field, and outputs said delayed video signal as a video signal for a previous field;

a luminance gradient detector that detects a luminance gradient of said image based on said video signal for said current field and said video signal for said previous field output from said field delay unit;

a differential calculator that calculates a difference between said video signal for said current field and said video signal for said previous field output from said field delay unit; and a motion amount calculator that calculates an amount of motion of said image based on the difference calculated by said different calculator and the gradient detected by said luminance gradient detector.

2. The image display apparatus according to claim 1, wherein said luminance gradient detector includes a gradient determiner that detects a plurality of gradient values based on said video signal for said current field and said video signal for said previous field output from said field delay unit to determine a luminance gradient of said image based on said plurality of gradient values.

3. The image display apparatus according to claim 2, wherein said luminance gradient detector includes an average gradient determiner that determines an average value of said plurality of gradient values as a luminance gradient of said image.

4. The image display apparatus according to claim 2, wherein said luminance gradient detector includes a maximum gradient determiner that determines a maximum value of said plurality of gradient values as a luminance gradient of said image.

5. The image display apparatus according to claim 1, wherein said video signal includes a red signal, a green signal, and a blue signal, said luminance gradient detector includes a color signal gradient detector that detects gradients between a red signal for said current field and a red signal for said previous field output from said field delay unit, between a green signal for said current field and a green signal for said previous field output from said field delay unit, and between a blue signal for said current field and a blue signal for said previous field output from said field delay unit, respectively, and said differential calculator includes a color signal differential calculator that calculates differences between said red signal for said current field and said red signal for said previous field output from said field delay unit, between said green signal for said current field and said green signal for said previous field output from said field delay unit, and between said blue signal for said current field and said blue signal for said previous field output from said field delay unit, respectively.

6. The image display apparatus according to claim 1, wherein said video signal includes a red signal, a green signal, and a blue signal, and said image display apparatus further comprises a luminance signal generator that generates a luminance signal for said current field by synthesizing said red, green, and blue signals for said current field at a ratio of approximately 0.30:0.59:0.11, and generates a luminance signal for said previous field by synthesizing said red, green, and blue signals output from said field delay unit at a ratio of approximately 0.30:0.59:0.11, and wherein said luminance gradient detector detects a luminance gradient of said image based on said luminance signal for said current field and said luminance signal for said previous field output from said field delay unit, and said differential calculator calculates a difference between said luminance signal for said current field and said luminance signal for said previous field output from said field delay unit.

7. The image display apparatus according to claim 1, wherein said video signal includes a red signal, a green signal, and a blue signal, said image display apparatus further comprises a luminance signal generator that generates a luminance signal for said current field by synthesizing red, green, and blue signals for said current field at any of the ratios of approximately 2:1:1, approximately 1:2:1, and approximately 1:1:2, and generates a luminance signal for said previous field by synthesizing red, green, and blue signals for said previous field output from said field delay unit at any of the ratios of approximately 2:1:1, approximately 1:2:1, and approximately 1:1:2, and wherein said luminance gradient detector detects a luminance gradient of said image based on said luminance signal for said current field and said luminance signal for said previous field output from said field delay unit, and said differential calculator calculates a difference between said luminance signal for said current field and said luminance signal for said previous field output from said field delay unit.

8. The image display apparatus according to claim 1, wherein said video signal includes a luminance signal, and said luminance gradient detector detects a gradient based on said luminance signal.

9. The image display apparatus according to claim 1, wherein said luminance gradient detector includes a gradient value detector that detects a plurality of gradient values using video signals of a plurality of pixels surrounding a pixel of interest.

10. The image display apparatus according to claim 1, wherein said motion amount calculator includes calculating said amount of motion by calculating a ratio of said difference calculated by said differential calculator to said luminance gradient of said image detected by said luminance gradient detector.

11. The image display apparatus according to claim 1, wherein said video signal includes a red signal, a green signal, and a blue signal, and said luminance gradient detector includes a color signal gradient detector that detects gradients between a red signal for said current field and a red signal for said previous field output from said field delay unit, between a green signal for said current field and a green signal for said previous field output from said field delay unit, and between a blue signal for said current field and a blue signal for said previous field output from said field delay unit, respectively, said differential detector includes a color signal differential calculator that calculates differences between said red signal for said current field and said red signal for said previous field output from said field delay unit, between said green signal for said current field and said green signal for said previous field output from said field delay unit, and between said blue signal for said current field and said blue signal for said previous field output from said field delay unit, respectively, and said motion amount calculator calculates a ratio of said difference between said red signals calculated by said color signal differential calculator to said gradient between said red signals detected by said color signal gradient detector, a ratio of said difference between said green signals calculated by said color signal differential calculator to said gradient between said green signals detected by said color signal gradient detector, and a ratio of said difference between said blue signals calculated by said color signal differential calculator to said gradient between said blue signals detected by said color signal gradient detector, so as to determine amounts of motion corresponding to said red, green, and blue signals, respectively.

12. The image display apparatus according to claim 1, further comprising an image processor that performs image processing on said video signal based on said amount of motion of said image calculated by said motion amount calculator.

13. The image display apparatus according to claim 12, wherein said image processor includes a diffusion processor that performs diffusion processing based on said amount of motion calculated by said motion amount calculator.

14. The image display apparatus according to claim 13, wherein said diffusion processor varies an amount of diffusion based on said amount of motion calculated by said motion amount calculator.

15. The image display apparatus according to claim 13, wherein said diffusion processor performs a temporal and/or spatial diffusion based on said amount of motion calculated by said motion amount calculator in said grayscale representation by said grayscale display unit.

16. The image display apparatus according to claim 13, wherein said diffusion processor performs error diffusion so as to diffuse a difference between an unrepresentable grayscale level and a representable grayscale level close to said unrepresentable grayscale level to surrounding pixels based on said amount of motion calculated by said motion amount calculator in said grayscale representation by said grayscale display unit.

17. The image display apparatus according to claim 12, wherein said image processor selects a combination of grayscale levels based on said amount of motion calculated by said motion amount calculator in said grayscale representation by said grayscale display unit.

18. The image display apparatus according to claim 12, wherein said image processor selects a combination of grayscale levels that is more unlikely to cause a dynamic false contour as said amount of motion calculated by said motion amount calculator becomes greater.

19. An image display method for displaying an image based on a video signal, comprising the steps of:

dividing said video signal for each field into a plurality of sub-fields, each of which is weighted according to the duration of time or number of pulses, and temporally superimposing said plurality of sub-fields for display to provide a grayscale representation;

delaying a video signal for a current field by one field, and outputting said delayed video signal as a video signal for a previous field;

detecting a luminance gradient of said image based on said video signal for said current field and said video signal for said previous field;

calculating a difference between said video signal for said current field and said video signal for said previous field; and calculating an amount of motion of said image based on said calculated difference and said detected gradient.

20. The image display method according to claim 19, further comprising the step of performing image processing on said video signal based on said calculated amount of motion of said image.

* * * * *